US007869741B2

(12) United States Patent
Mayuzumi et al.

(10) Patent No.: US 7,869,741 B2
(45) Date of Patent: Jan. 11, 2011

(54) CHARGING MEMBER INCLUDING A CONDUCTIVE SUPPORT AND SURFACE LAYER HAVING PROTRUSIONS FORMED ON A SURFACE THEREOF, A PROCESS CARTRIDGE INCLUDING SAME FOR USE IN AN IMAGE FORMING APPARATUS

(75) Inventors: Hiroshi Mayuzumi, Yokohama (JP); Tomohito Taniguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/699,380

(22) Filed: Feb. 3, 2010

(65) Prior Publication Data

US 2010/0135695 A1 Jun. 3, 2010

Related U.S. Application Data

(63) Continuation of application No. PCT/JP2009/068936, filed on Oct. 29, 2009.

(30) Foreign Application Priority Data

Oct. 31, 2008 (JP) ..... 2008-281601

(51) Int. Cl.
*G03G 21/18* (2006.01)
*G03G 15/02* (2006.01)

(52) U.S. Cl. ..... 399/115; 399/168

(58) Field of Classification Search ..... 399/50, 399/115, 168, 174, 176
See application file for complete search history.

(56) References Cited

U.S. PATENT DOCUMENTS 7,054,579 B2 5/2006 Taniguchi et al.
7,366,448 B2 4/2008 Taniguchi et al.
2010/0142998 A1 6/2010 Furukawa et al.

FOREIGN PATENT DOCUMENTS

| | | | |
|---|---|---|---|
| JP | 4-057073 A | | 2/1992 |
| JP | 2001-092221 A | | 4/2001 |
| JP | 2003-162130 A | | 6/2003 |
| JP | 2003-316112 A | | 11/2003 |
| JP | 2004-240357 A | | 8/2004 |
| JP | 2005-037931 A | | 2/2005 |
| JP | 2006-065059 A | | 3/2006 |
| JP | 2006065059 A | * | 3/2006 |
| JP | 2006-154442 A | | 6/2006 |
| JP | 2007-127777 A | | 5/2007 |
| JP | 2009-156906 A | | 7/2009 |

* cited by examiner

*Primary Examiner*—David M Gray
*Assistant Examiner*—Billy J Lactaoen
(74) *Attorney, Agent, or Firm*—Fitzpatrick, Cella, Harper & Scinto

(57) ABSTRACT

A charging member is provided which can inhibit defective images due to poor charging and adhering substances from occurring even after being repeatedly used for a long time, and can inhibit deformation and defective images due to the C set, caused by a change in rotational speed accompanying such deformation even after being left standing in a stopping state for a long time. The charging member includes a conductive support and a surface layer. The surface layer includes a binder and resin particles dispersed in the binder, each resin particle having a depressed portion on its surface. Protrusions resulting from the resin particles are formed on the surface of the surface layer. The protrusions each have a depressed portion resulting from the depressed portion of the resin particle, and the surface of the resin particle is covered with the binder.

6 Claims, 3 Drawing Sheets

CHARGING MEMBER INCLUDING A CONDUCTIVE SUPPORT AND SURFACE LAYER HAVING PROTRUSIONS FORMED ON A SURFACE THEREOF, A PROCESS CARTRIDGE INCLUDING SAME FOR USE IN AN IMAGE FORMING APPARATUS

This application is a continuation of International Application No. PCT/JP2009/068936, filed on Oct. 29, 2009, which claims the benefit of Japanese Patent Application No. 2008-281601 filed on Oct. 31, 2008.

BACKGROUND OF THE INVENTION

1. Field of the Invention

The present invention relates to a charging member, an electrophotographic apparatus and a process cartridge in which the charging member is used.

2. Description of the Related Art

As a charging member used for contact charging, Japanese Patent Application Laid-Open No. 2003-316112 discloses a charging member in which resin particles are contained in the surface of the charging member to form irregularities in order to suppress charging unevenness in a photosensitive member.

The surface of a charging member used for contact charging is gradually contaminated with use by adhesion of substances attributed to a developer, for example, a toner, an external additive, paper powders, etc. This tendency is remarkable particularly in a charging member having irregularities formed on the surface thereof as described above. When using a charging member in which these substances have adhered to its surface is used to form an electrophotographic image, defects in dot or streak form occur in- some cases in the electrophotographic image due to charging unevenness attributed to the contamination. Such defects are observed particularly remarkably in halftone images. Moreover, the defects are liable to occur particularly in a method of applying only direct voltage to a charging member to charge a photosensitive member.

A charging member used for contact charging always contacts a photosensitive member. Therefore, when an electrophotographic apparatus is left standing in a state of rest for a long time, a certain portion of the charging member is in pressure contact with the photosensitive member. As a result, deformation that is not easily restored, i.e., the so-called permanent deformation occurs in some cases in the pressure contacting portion. Hereinafter, such deformation is referred to as "compression set" or "C set". When a charging member having the C set is used to form an electrophotographic image, striped unevenness occurs in some cases in the electrophotographic image corresponding to the portion where the C set has occurred.

SUMMARY OF THE INVENTION

The present invention is directed to provide a charging member that can suppress occurrence of defects in an electrophotographic image attributed to contamination of the surface of the charging member, and suppress occurrence of unevenness in an electrophotographic image attributed to the C set. The present invention is directed to provide an electrophotographic apparatus and a process cartridge that can stably provide an electrophotographic image with high quality.

According to one aspect of the present invention, there is provided a charging member comprising a conductive support, and a surface layer, wherein surface layer comprises resin particles each having a depressed portion on the surface thereof, and a binder in which resin particles are dispersed, wherein protrusions resulting from resin particles are formed on the surface of the surface layer, and protrusions each have a depressed portion resulting from said depressed portion of resin particle, and wherein resin particles are covered with said binder.

According to another aspect of the present invention, there is provided a process cartridge which comprises the above-mentioned charging member and a photosensitive member disposed in contact with the charging member, and is detachably mountable to a body of an electrophotographic apparatus.

According to further aspect of the present invention, there is provided An electrophotographic apparatus comprising the above-mentioned charging member, and a photosensitive member disposed in contact with the charging member.

According to the present invention, blotches in an image due to poor charging and adhering substances can be inhibited from occurring even when the electrophotographic apparatus is repeatedly used for a long time. Additionally, striped unevenness in an image due to the C set can be inhibited from occurring even after the electrophotographic apparatus is left standing in a stopped state for a long time.

Further features of the present invention will become apparent from the following description of exemplary embodiments with reference to the attached drawings.

DESCRIPTION OF THE EMBODIMENTS

Figure 3:
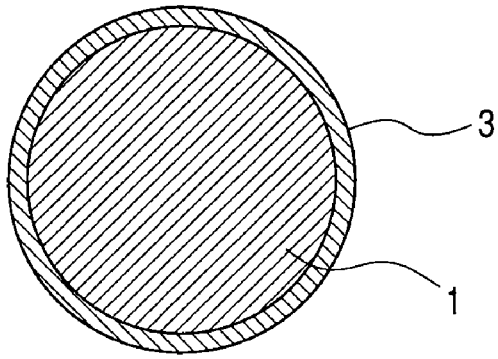
FIG. 3 is a sectional view illustrating an example of the charging member according to the present invention.

FIG. 3 illustrates a cross section of a charging member according to the present invention. The charging member includes a conductive support 1 and a surface layer that covers the peripheral surface of the conductive support 1.

[A Surface Layer]

Figure 2:
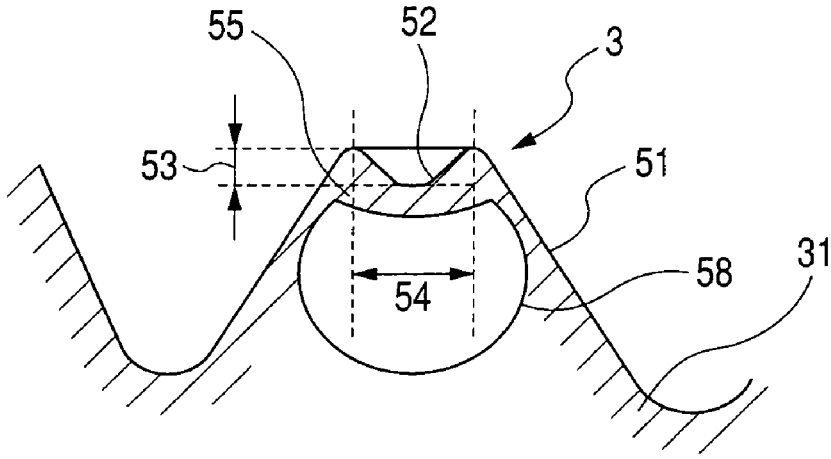
FIG. 2 is a cross section illustrating a surface layer, which is an example of the charging member according to the present invention.

FIG. 2 is an enlarged sectional view of a portion of the surface layer 3. The surface layer 3 includes resin particles 58 each having a depressed portion on the surface of the resin particle 58 and a binder 31 in which the resin particles are dispersed. The resin particles 58 are covered with the binder 31. Further, the surface of the surface layer 3 has protrusions 51 resulting from the resin particles 58. A depressed portion 52 resulting from the depressed portion 55 of the resin particle 58 is formed at the peak of the protrusion 51.

With respect to a conventional charging member, the present inventors conducted studies into the cause of deposition of adhering substances, such as toner onto the surface thereof, and the cause of occurrence of unevenness in an electrophotographic image due to the C set. During the course of the studies, contacting and rotational states of such a charging member and a photosensitive member were observed in detail. As a result, it has been found that the surface of the charging member is likely to become contaminated under circumstances in which slipping between the charging member and the photosensitive member is easily generated. It is considered that this is because slipping causes a developer or the like on the photosensitive member to be crushed and firmly adhere onto the charging member.

Then, the present inventors conducted studies on countermeasures that make it difficult for the developer or the like on the photosensitive member to adhere onto the charging member. During the course of the studies, a depressed portion was formed on the surface of a resin particle that formed a protrusion on the surface of the charging member, and the contacting state between the charging member including this resin particle used for a surface layer and a photosensitive member was observed. As a result, the charging member having no depressed portions in the protrusions on the surface of the charging member contacts the photosensitive member only in the vicinity of the peak of the protrusion. On the other hand, the contact area between the charging member and the photosensitive member is increased in the charging member having the protrusions on the surface of the charging member, the protrusions each having the depressed portion at the peak thereof. Therefore, rotation of the charging member according to the photosensitive member was stabilized so that slipping was inhibited. Further, knowledge was obtained that contact pressure in the contacting portion between the charging member and the photosensitive member is dispersed to efficiently inhibit the developer or the like on the photosensitive member from being crushed and adhering onto the charging member.

In the charging member having the C set, when the portion having the C set contacts the photosensitive member, a rotational speed of the charging member is changed. Such a change in the rotational speed causes charging unevenness in the photosensitive member. However, it was discovered that even in such a charging member having the C set, occurrence of striped unevenness attributed to the C set in the image can be suppressed in the charging member having the protrusions on the surface of the charging member, the protrusions each having the depressed portion at the peak of the protrusion. It is considered that this is because the contact area between the charging member and the photosensitive member increases so that a large change in the rotational speed is suppressed even when the C set portion contacts the photosensitive member. Further, it was discovered that pressure in the contact portion between the charging member and the photosensitive member is dispersed by an increase in the contact area due to the protrusions and the quantity of deformation in the surface itself related to. the C set can be made smaller. The present invention is based on such knowledge of the present inventors.

A depressed portion 52 formed at the peak of the protrusion 51 that the surface layer 3 has may have an opening diameter 54 of not less than 0.5 μm and not more than 5 μm. When the opening diameter 54 is not less than 0.5 μm, the contact area between the charging member and the photosensitive member can be increased, and further, the contact pressure between the charging member and the photosensitive member can be dispersed on the contact surface. When the opening diameter is not more than 5 μm, deformation of the resin particle 58 caused by contact between the charging member and the photosensitive member can be inhibited, the resin particle 58 forming the protrusion 51 on the surface of the surface layer 3. Moreover, the opening of the depressed portion 52 has preferably a maximum depth 53 of not less than 0.5 μm and not more than 2 μm. As long as the maximum depth 53 of the opening is within this range in relation to the opening diameter, the photosensitive member can contact the whole surface of the depressed portion 52 to increase the contact area when the charging member contacts the photosensitive member. Accordingly, deformation of the resin particles when the charging member contacts the photosensitive member can be prevented. Thereby, occurrence of striped unevenness in the image attributed to the C set and occurrence of blotches in the image attributed to surface contamination can be suppressed more surely.

The protrusions having the shape of the protrusion 51, i.e., having the depressed portion 52 at the peak of the protrusion being preferably not less than 80% with respect to the total number of the protrusions formed on the surface of the surface layer 3. Thereby, the contact area between the charging member and the photosensitive member can be increased, and defective images due to the C set image or surface contamination can be further inhibited from occurring. The resin particles 58 are also covered with the binder resin 31, thereby inhibiting the resin particles 58 coming off from the surface layer 3. It is preferable that not less than 50% of the surface area of the depressed portions 55 is covered with the binder.

Figure 1:
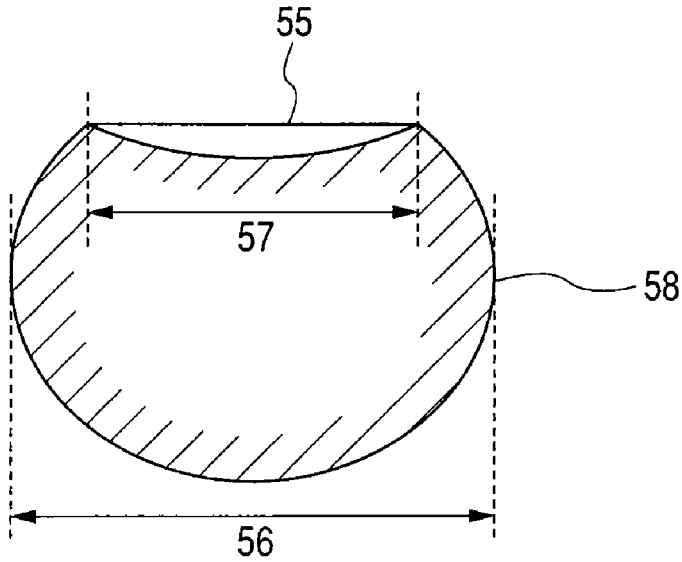
FIG. 1 is a schematic view illustrating a resin particle contained in a surface layer, which is an example of a charging member according to the present invention.

FIG. 1 is a sectional view of the resin particle 58 dispersed in the surface layer 3. The resin particles 58 have preferably an average particle size of not less than 1 μm and not more than 50 μm, and particularly, of not less than 5 μm and not more than 35 μm. When the average particle size of the resin particles is not more than 50 μm, the resin particles can be inhibited from coming off from the charging member surface even in long-term use. When the average particle size of the resin particles is not less than 1 μm, the photosensitive member can be charged stably by generation of discharge. In order to produce the resin particles having such an average particle size, the amount of a surfactant to be added, the amount of a dispersion stabilizer to be added, a stirring speed, etc. can be adjusted appropriately at the time of production. The average particle size of the resin particles can be found from measured values obtained by measuring powdered resin particles using a Coulter Counter Multisizer or the like. Specifically, 0.1 to 5 ml of a surfactant (alkylbenzene sulfonate) is added to 100 to 150 ml of an electrolytic solution, and 2 to 20 mg of a test sample (resin particle) is added to this solution. A sample of a suspended electrolyte liquid is subjected to a dispersion process for 1 to 3 minutes by an ultrasonic dispersing machine. Using an aperture of 17 μm or 100 μm according to the Coulter Counter Multisizer in conformity with resin particle sizes, the distribution of particle sizes from 0.3 to 64 μm is measured with reference to volume. The mass average particle size measured in this condition is determined by a computer processing.

The depressed portions 55 of the resin particles 58 can have an opening diameter 57 of not less than 0.2 μm and not more than 25 μm on average, and can have an average depth of not less than 0.2 μm and not more than 5 μm. The depressed portions 55 of the resin particles preferably have an opening within the range of not less than 0.05 and not more than 0.5 on average in a ratio of the opening diameter 57 to the diameter 56 of the resin particle (hereinafter referred to as "opening ratio"). When the opening ratio is not less than 0.05, pressure applied to the surface of the charging member by contact of the charging member and the photosensitive member can be further dispersed. As a result, defective images due to surface contamination can be more surely inhibited from occurring.

Moreover, when the opening ratio is not more than 0.5, deformation of the resin particle 58 caused by contact of the charging member and the photosensitive member can be suppressed even when the charging member is not driven for a long time, and defective images due to the C set can be more surely inhibited from occurring.

The hardness of the resin particle 58 can be not less than $1\times10^{-5}$ N and not more than $1\times10^{-4}$ N. When the hardness of the resin particle is not less than $1\times10^{-5}$ N, deformation of the resin particle caused by contact of the charging member and the photosensitive member can be suppressed even when the charging member is not driven for a long time, and defective images due to the C set image can be more surely inhibited from occurring. Moreover, when the hardness of the resin particle is not more than $1\times10^{-4}$ N, pressure applied to the surface of the charging member by contact of the charging member and the photosensitive member can be further dispersed. As a result, defective images due to surface contamination can be more surely inhibited from occurring.

<A Method for Forming a Surface Layer>

A method for forming the surface layer 3 includes the following two methods.

<<Method 1>>

The resin particles 58 each having the depressed portion 55 are produced. Subsequently, a coating solution in which the resin particles 58 are dispersed in a binder or a raw material of a binder is prepared. The coating solution is applied onto a conductive support or an elastic layer, and dried and hardened to form the surface layer 3.

<<Method 2>>

Spherical resin particles having no depressed portion are produced. A coating solution in which the resin particles are dispersed in a binder or a raw material of a binder is prepared. At this time, a volatile solvent capable of swelling the spherical resin particles is added into the coating solution to cause the spherical resin particles to swell in the coating. This coating solution is applied onto a conductive support or an elastic layer. Subsequently, the applied layer of the coating is dried and hardened. In this drying and hardening process, the drying rate of the applied layer, the hardening rate of the applied layer, and a volatilization rate of the solvent from the swollen spherical resin particles are adjusted. Thereby, the spherical resin particles can be transformed into the resin particles 58, and the surface layer 3 having the protrusions 51 can be formed. Hereinafter, details of these methods will be given.

<<Regarding Method 1>>

First, a description will be given of a method for preparing the resin particles 58 used for Method 1. A monomer or a polymerized compound that forms resin particles, a plasticizer that is insoluble in water and does not react with the monomer or the polymerized compound, and when necessary, a polymerization initiator, a surfactant, a dispersion stabilizer, etc. are added into an aqueous medium and mixed with stirring to obtain a mixed solution in which fine droplets are dispersed. Subsequently, the mixed solution is heated while the mixed solution is stirred under a nitrogen atmosphere. A depressed portion forming agent is mixed, and the monomer or the polymerized compound is polymerized.

Specifically, the monomer may include the following: alkyl acrylates such as ethyl acrylate and methacrylic acrylate; unsaturated esters such as alkyl methacrylate, allyl acrylate, and diallyl maleate; unsaturated hydrocarbons such as styrene, vinyltoluene, propylene, butadiene, divinylbenzene, divinylnaphthalene, and divinyl ether; acrylonitrile, organosiloxane having a polymerized group, and polyurethane having a polymerized group; and carboxylate esters having not less than two unsaturated groups, such as divinylbenzene, and ethylene glycol dimethacrylate.

The polymerized compound includes a combination of an isocyanate compound and an amine that can react with isocyanate or a combination of an isocyanate compound and a polyol that can react with isocyanate. Specific examples of the isocyanate compound include the following: trimethylene diisocyanate, hexamethylene diisocyanate, phenylene diisocyanate, tolylene diisocyanate, diphenylmethane-4,4'-diisocyanate, and triphenylmethane diisocyanate; and adducts of tolylene diisocyanate and trimethylolpropane, adducts of xylenediisocyanate and trimethylolpropane, etc. Examples of amines that can react with the isocyanate compounds include ethylenediamine, trimethylenediamine, tetramethylenediamine, pentamethylene diamine, and hexamethylenediamine. Examples of polyols that can react with the isocyanate compound include ethylglycol, propylglycol, 1,4-butanediol, and catechol.

As the depressed portion forming agent, such an organic solvent is used that is insoluble in water, does not react with the monomer or the polymerized compound, and has volatility at normal temperature. Examples of the depressed portion forming agent include hydrocarbons such as pentane, hexane, heptane, decane, limonene, and diethylether. The amount of these hydrocarbons to be added may be in the range of not less than one part by mass and not more than 30 parts by mass with respect to 100 parts by mass of the monomer.

Specifically, the dispersion stabilizer can include the following: gelatin, glycerol, and polyvinyl alcohol; dodecylbenzenesulfonic acid, and nonyl phenol phenyl ether disulfonic acid potassium; and ammonium stearate, polyoxyethylene nonylphenyl ether sulfonate ammonium, and polyoxyethylene octylphenyl ether sulfate ammonium. As the polymerization initiator, organic peroxides such as benzoyl peroxide, lauroyl peroxide, and diisopropylbenzene hydroperoxide and transition metal salts such as iron sulfate, iron carbonate, and copper iodide can be used.

As the plasticizer, fatty acid esters, liquid paraffin, olefin, etc. can be used. The depth and the opening diameter of the depressed portion formed in the resin particle can be adjusted by appropriately adjusting the amount of the plasticizer to be added and the material of the plasticizer. The amount of the plasticizer to be added can be within the range of not less than 0.1 part by mass and not more than 3 parts by mass to 100 parts by mass of the monomer.

When suspension polymerization or emulsion polymerization is performed using the depressed portion forming agent as described above, spherical particles containing hydrocarbon as the depressed portion forming agent in a shell including the resin made of the above-mentioned monomer or polymerized compound are obtained. When the spherical particles are dried, the contained depressed portion forming agent passes through the shell to volatilize so that the inside of the spherical particle becomes hollow. As a result, the spherical particle is crushed by atmospheric pressure to obtain the resin particle 58 having the depressed portion 55. The size of the depressed portion of the resin particle 58 varies according to a difference in volatility of the depressed portion forming agent. Accordingly, the opening diameter and maximum depth of the depressed portion 55 can be adjusted by selection of the depressed portion forming agent.

The resin particles 58 obtained by the above-mentioned method are mixed with the binder, a dispersion medium, and the like to prepare the coating solution. Then, this coating is applied onto a conductive support or an elastic layer by a known method such as dipping and spraying, and is dried to obtain the surface layer 3.

The dispersion medium can be selected appropriately according to the material of the resin particle and hardening conditions of the binder. When the resin particle 58 is made of a material having a comparatively higher polarity, such as acrylic resins and urethane resins, the following may be cited as a preferable dispersion medium: alcohols (methanol, ethanol, isopropanol, etc.); ketones (acetone, methyl ethyl ketone, cyclohexanone, etc.); amides (N,N-dimethylformamide, N,N-dimethylacetamide, etc.); sulfoxides (dimethyl sulfoxide, etc.); ethers (tetrahydrofuran, dioxane, ethylene glycol monomethyl ether, etc.); and esters (methyl acetate, ethyl acetate, etc.).

Care should be taken not to break up the resin particles 58 in the dispersion process at the time of preparing the coating solution. Specifically, dispersion time may be made shorter than under normal dispersion conditions so as to be approximately 0.5 to 5 hours.

Further, in order for the depressed portions 52 to be located at the peaks of the protrusions 51 formed on the surface of the surface layer 3, the resin particles 58 should be caused to exist in the surface layer so that the depressed portions 55 face the surface side. In order to cause the resin particles 58 to exist in this way, the drying temperature for the applied layer should be raised in the process of drying the applied layer of the coating solution, or the solid content of the coating solution should be reduced. Thereby, the volatilization rate at which the dispersion medium of the coating volatilizes from the applied layer is increased, whereby the depressed portions 55 of the resin particles 58 can be directed toward the surface side by a flow of the dispersion medium that volatilizes at a high speed.

As a specific example of the method for forming the surface layer 3, first, components to be dispersed other than the resin particle 58, such as conductive fine particulates, are mixed with the binder and glass beads having a diameter of 0.8 mm, and are dispersed over 24 hours to 36 hours by means of a paint shaker dispersing machine. Subsequently, the resin particles 58 are added and dispersed. The dispersion time can be 1 hour to 3 hours. Thereafter, the resulting mixture is adjusted so as to have viscosity of 3 to 30 mPa and more preferably 3 to 10 mPa to prepare the coating. After that, by dipping or the like, the applied layer of the coating solution is formed on a conductive support or an elastic layer so as to have a dried layer thickness of 1 to 50 μm and more preferably 5 to 30 μm. This applied layer is dried at a temperature of 20 to 50° C., and particularly a temperature of 30 to 50° C. The surface layer 3 can be formed by such a method.

<<Regarding Method 2>>

Method 2 is a method in which resin particles having no depressed portion are dispersed in a coating solution for forming the surface layer, and during the process of drying the applied layer of this coating solution, the surface layer 3 is formed while part of each of the spherical resin particles is depressed to form the resin particles 58.

Specifically, a solvent that swells the spherical resin particles is added into the coating. The applied layer of this coating is formed on a conductive support or an elastic layer by dipping or the like. The applied layer is dried to form the surface layer. A thermosetting resin is used as the binder in the coating solution. Further, the difference between the hardening temperature and the vaporization temperature of the solvent that swells the spherical resin particles in the coating solution is brought close to approximately 20° C. Thereby, the solvent can vaporize from the swollen spherical resin particles before the binder completely hardens. Then, part of the spherical resin particle is deformed by vaporization of the solvent from the swollen spherical resin particles so that the spherical resin particle turns into the resin particle 58. Since the binder is not completely hardened at this time, the binder is adapted to the shape of the depressed portion 55 of the resin particle 58. As a result, the surface layer 3 having the characteristic surface shape is formed. Method 2 can form the depressed portion 54 at the peak of the protrusion 51 more easily than Method 1.

The content of the above-mentioned resin particle in the surface layer is preferably not less than 2 parts by mass and not more than 120 parts by mass with respect to 100 parts by mass of the binder, more preferably not less than 5 parts by mass and not more than 100 parts by mass, and still more preferably not less than 5 parts by mass and not more than 50 parts by mass. When the content of the resin particle is not less than 2 parts by mass, stable contact of the charging member and the photosensitive member can be attained. When the content of the resin particle is not more than 120 parts by mass, surface roughness can be easily controlled.

The binder used in the above-mentioned Method 1 may include, for example, resins, natural rubbers, and synthetic rubbers. Resins such as thermosetting resins and thermoplastic resins can be used as the resin. Especially, from the viewpoint of easily controlling the viscosity of the coating solution, the following resins are preferable: fluorocarbon polymers, polyamide resins, acrylic resins, polyurethane resins, silicone resins, butyral resins, etc. The synthetic rubber includes ethylene-propylene-diene copolymers (EPDM), styrene-butadiene copolymerization rubbers (SBR), silicone rubbers, urethane rubbers, isoprene rubbers (IR), butyl rubbers, acrylonitrile-butadiene copolymerization rubber (NBR), chloroprene rubber (CR), acrylic rubbers, epichlorhydrin rubber, and the like. Thermosetting resins and rubbers may be used as the binder for the above-mentioned Method 2.

Additionally, in order to easily form the depressed portion, as the spherical resin particles used in the above-mentioned Method 2, resin particles whose material can be swollen by the solvent is used. Specifically, the spherical resin particles can be selected appropriately from the following in consideration of the degree of swelling by the solvent to be used: polyamide resins, silicone resins, fluorocarbon polymers, (meth)acrylic resins, styrene resins, phenol resins, polyester resins, melamine resins, urethane resins, naphthalene resins, furan resins, xylene resins, olefine resins, and epoxy resins; resins such as copolymers, modified products or derivatives of these; ethylene-propylene-diene copolymers (EPDM), divinylbenzene polymers, styrene-divinylbenzene copolymers, and polyacrylonitrile; styrene-butadiene copolymerization rubbers (SBR), silicone rubbers, urethane rubbers, isoprene rubbers (IR), butyl rubbers, and acrylonitrile-butadiene copolymerization rubber (NBR); rubbers such as chloroprene rubber (CR) and epichlorohydrin rubbers; polyolefin thermoplastic elastomers, urethane thermoplastic elastomers, polystyrene thermoplastic elastomers, fluororubber thermoplastic elastomers, polyester thermoplastic elastomers, and polyamide thermoplastic elastomers; and thermoplastic elastomers such as polybutadiene thermoplastic elastomers, ethylene vinyl acetate thermoplastic elastomers, polyvinyl chloride thermoplastic elastomers, and chlorinated polyethylene thermoplastic elastomers. Among these, acrylic resins, urethane resins, silicone resins, and styrene resins are preferable because it is easy to form the depressed portion.

The resin particles 58 preferably contain carbon black. When carbon black is included in the resin particles, even if the charging member is brought into contact for a long time with the photosensitive member to be charged, the resin particles can be inhibited from deforming. Therefore, defective images due to the C set can be more surely inhibited from occurring. The content of carbon black in the resin particles can be not less than 5 parts by mass and not more than 20 parts by mass with respect to the total amount of the resin of which the resin particles are made. When carbon black is included in this range, the resin particle and the depressed portion thereof can be inhibited from deforming and also the hardness of the resin particle can easily be controlled so as to be in a desired range. Carbon black contained in the resin particle can be HAF, FEF, ISAF, SAF, SRF, FT, EPC, MPC, etc. The resin particles 58 can contain silica. When silica is included in the resin particles, the affinity of the binder with the resin particles that form the surface layer can be improved. Thereby, even when the charging member is not driven for a long time, deformation of the resin particle caused by contact of the charging member and the photosensitive member and deviation caused between the resin particles and the binder can be further suppressed. As a result, defective images due to the C set can be more surely inhibited from occurring. The content of silica can be not less than 3 parts by mass and not more than 20 parts by mass with respect to the total amount of the resin of which the resin particles are made. When silica is included in this range, the affinity of the resin particles with the binder is increased, and the hardness of the resin particles is inhibited from increasing. As silica contained in the resin particles, both dry process silica produced by vapor phase oxidization of a halogenated silicon compound or wet process silica produced from fumed silica, water glass, etc. may be used. Silica is composed preferably of fine particles having a primary particle size of approximately not more than 0.5 μm.

The content of the above-mentioned resin particles in the surface layer 3 is preferably not less than 2 parts by mass and not more than 120 parts by mass to the binder 100 parts by mass, more preferably not less than 5 parts by mass and not more than 100 parts by mass, and still more preferably not less than 5 parts by mass and not more than 50 parts by mass. When the content of the resin particle is not less than 2 parts by mass, stable contact of the charging member and the photosensitive member can be attained. When the content of the resin particle is not more than 120 parts by mass, surface roughness can be easily controlled. The surface layer 3 can have a volume resistivity of not less than $10^2$ Ωcm and not more than $10^{16}$ Ωcm under a 23° C./50% RH environment. When the surface layer has such a volume resistivity, the photosensitive member can be appropriately charged due to discharge. A measured value by the following measurement method can be used as the volume resistivity. Measurement is made under a 23° C./50% RH environment by using a resistance measurement apparatus "Hiresta-UP" (manufactured by Mitsubishi Chemical Corporation) and applying a voltage of 250 V to a sample to be measured for 30 seconds. When the surface layer is made up of a plurality of layers, a test sample is prepared from a material composition of each layer and the volume resistivity is measured. When the material composition of each layer is composed of a solid, such as a rubber or a resin, a sample so formed as to have a thickness of 2 mm by using a solid material is used. When the material composition of each layer is a coating liquid, a sample is used which is obtained by applying the coating liquid onto an aluminum sheet, and drying and solidifying the coating liquid.

The surface layer 3 preferably contains conductive fine particles other than the resin particles 58 in order to impart a predetermined volume resistivity to the surface layer. The conductive fine particles include the following: fine particles of metal such as aluminum, palladium, iron, copper, and silver; fine particles of metal oxide such as titanium oxide, tin oxide, and zinc oxide; and fine particles of carbon black such as furnace black, thermal black, acetylene black, and ketjen black. These conductive fine particles can be used each singly or in combination. Moreover, when carbon black is used, it is more preferable to use carbon black in the form of composite conductive fine particles made of metal oxide fine particles covered with carbon black. Since carbon black forms structures, it is difficult to cause carbon black to exist uniformly in the binder. When carbon black is used in the form of composite conductive fine particles made of a metal oxide covered with carbon black, carbon black can be uniformly dispersed into the binder. Accordingly, the volume resistivity can be more easily controlled. The metal oxide fine particles used for this purpose include metal oxides and composite metal oxides. Specifically, as the metal oxide, the following may be exemplified: zinc oxide, tin oxide, indium oxide, titanium oxides (titanium dioxide, titanium monoxide, etc.), iron oxide, silica, alumina, magnesium oxide, zirconium oxide, etc. In addition, as the composite metal oxide, the following may be exemplified: strontium titanate, calcium titanate, magnesium titanate, barium titanate, calcium zirconate, etc. It is more preferable that the metal oxide fine particles are subjected to surface treatment. For surface treatment, the following may be used: organic silicon compounds such as alkoxysilane, fluoroalkyl silane, and polysiloxane, various coupling agents of silane coupling agents, titanate coupling agents, aluminate coupling agents, and zirconate coupling agents, oligomers, or high molecular compounds. These may be used each singly or in combination. The average particle size of these conductive fine particles is preferably 0.01 μm to 0.9 μm and more preferably 0.01 μm to 0.5 μm for easily controlling the volume resistivity of the surface layer. The content of these conductive particles in the surface layer is preferably within the range in which the volume resistivity as described later can be imparted to the charging member. Specifically, for example, the range may be from 2 parts by mass to 80 parts by mass and preferably from 20 parts by mass to 60 parts by mass with respect to 100 parts by mass of the binder. Further, the surface layer may contain other additives in the range in which functions of the above-mentioned binder and the resin particles are not impaired. As the additives, the following may be exemplified: for example, zinc oxide, tin oxide, indium oxide, titanium oxides (titanium dioxide, titanium monoxide, etc.), iron oxide, silica, alumina, magnesium oxide, and zirconium oxide; strontium titanate, calcium titanate, magnesium titanate, barium titanate, calcium zirconate, barium sulfate, molybdenum disulfide, calcium carbonate, and magnesium carbonate; and particles of materials such as dolomite, talc, kaolin clay, mica, aluminum hydroxide, magnesium hydroxide, zeolite, wollastonite, diatomaceus earth, glass bead, bentonite, montmorillonite, hollow glass ball, graphite, organo-metallic compounds, and organic metal salts.

The thickness of the surface layer 3 can be selected in relation to the particle size of the resin particle 58, and is preferably not less than 1 μm and not more than 50 μm. The thickness of the surface layer in this range is preferable because the protrusions resulting from the resin particles can be formed efficiently and the resin particles can be covered with the binder. A roller is cut with a sharp cutter, and the cross section is observed with an optical microscope to measure the thickness of the surface layer.

[Conductive Support]

A conductive support has conductivity, supports a surface layer formed on the surface, and brings about discharge between a member, such as the photosensitive member, to be charged and the surface layer. Therefore, the conductive support functions as an electrode for applying to the surface layer a direct current voltage or a voltage in which a direct current voltage and an alternating current voltage are superimposed one on the other. The material of the conductive support includes, for example, metals such as iron, copper, stainless steel, aluminum, and nickel, and alloys of those.

[Charging Member]

The charging member according to the present invention need only have the above-mentioned conductive support and surface layer and may have any shape, such as a roller-like shape, a plate-like shape, etc. The charging member may have a functional layer such as an elastic layer between the conductive support and the surface layer. Particularly, the charging member preferably has an elastic layer for improving durability of the charging member.

It is preferable that the charging member according to the present invention usually has electric resistance of not less than $1\times10^2$ Ω and not more than $1\times10^{10}$ Ω in a 23° C. and 50% RH environment for suitably charging the photosensitive member. The microhardness of the above-mentioned charging member is preferably not less than 40° and not more than 75° . The protrusions resulting from the resin particles that the surface layer has have the depressed portions, and the microhardness of the charging member is not less than 50° . Thereby, excessive deformation of the charging member caused by contact of the charging member and the photosensitive member can be suppressed. When the microhardness of the charging member is not more than 60° , the contact area between the depressed portions that the surface layer has and the photosensitive member can be significantly increased. Therefore, slipping during rotation can be inhibited from occurring. A measured value obtained by measurement in a peak hold mode in a 23° C./55% environment by means of a microhardness tester MD-1 type (made by KOBUNSHI KEIKI CO., LTD.) can be employed as the microhardness.

In the above-mentioned charging member, the 10-point average roughness Rz (μm) of the surface is preferably $2\leqq Rz\leqq 30$, and the average irregularity distance Sm (μm) of the surface is preferably $15\leqq Sm\leqq 150$. The 10-point average roughness Rz (μm) of the charging member surface is more preferably $3\leqq Rz\leqq 150$. The average irregularity distance Sm (μm) of the charging member surface is more preferably $20\leqq Sm\leqq 150$. When the surface roughness Rz and average irregularity distance Sm of the charging member surface are respectively within the above-mentioned ranges, image defects attributed to poor discharge or contamination can be suppressed. Values measured according to Japanese Industrial Standard JIS B0601-1994 can be employed as the 10-point average roughness Rz and the average irregularity distance Sm of the surface. Measurement is performed using a surface roughness measuring instrument (trade name: SE-3500, made by Kosaka Laboratory Ltd.). As for Rz, measurement is performed at six positions at random on the surface of the charging member, and the average value may be employed. As for Sm, six positions are selected from the surface of the charging member at random, irregularity distances at 10 spots are measured, and the average value may be employed.

When the above-mentioned charging member has a roller-like shape, in order to bring the charging member into uniform contact with the photosensitive member, the charging member preferably has the so-called crown shape in which the charging member is thickest in the central portion in the longitudinal direction of the charging member and becomes thinner toward both ends in the longitudinal direction. A cylindrical charging member generally comes into contact with the photosensitive member in such a state that the charging member is pressed at both ends of the support. The pressing pressure is smaller in the central portion in the longitudinal direction of the charging member and is larger towards both ends in the longitudinal direction. Therefore, density unevenness occurs between an image corresponding to the central portion and an image corresponding to both ends. The crown shape can suppress such density unevenness. As to a crown amount, the difference between the outer diameter of the central portion and the outer diameter at a position 90 mm away from the central portion is preferably not less than 30 μm and not more than 200 μm. When the difference is not less than 30 μm, such a state that both ends are in contact and the central portion is not in contact can be avoided. When the difference is not more than 200 μm, such a state that the central portion is contacted and both ends are not contacted can be avoided.

The form of the charging member includes a roller-like shape having the conductive support 1 and the surface layer 3 that covers the peripheral surface of the conductive support 1, as illustrated in FIG. 3. An elastic layer may be provided between the conductive support 1 and the surface layer 3 when necessary. Additionally, the form of the charging member is not limited to the roller-like shape, and may be a plate-like shape or a belt-like shape.

The elastic layer with which the charging member is provided can be made of an elastomer such as rubbers and thermoplastic elastomers. Among these, from the viewpoint of ensuring a sufficient nip between the charging member and the photosensitive member, rubbers are preferable, and synthetic rubbers are more preferable. Among the synthetic rubbers, polar rubbers are cited as preferable examples because they have uniform resistance. Specifically, NBR, epichlorohydrin rubber, and the like are preferable because the resistance and hardness of the elastic cover layer. A volume resistivity of the elastic layer can be not less than $10^2$ Ωcm and not more than $10^{10}$ Ωcm in an environment of a temperature of 23° C. and a humidity of 50% RH. The volume resistivity of the elastic layer can be adjusted by appropriately adding a conducting agent, such as carbon black, conductive metallic oxides, alkali metal salts, and ammonium salts into a binding material. Ammonium salts is preferably used when the binding material is a polar rubber. In order to adjust hardness, the elastic layer may contain additives, such as a softening oil, and a plasticizer and the above-mentioned insulating particles other than the conductive particulates. The elastic layer may be provided by adhering with an adhesive between the conductive support and the surface layer. It is preferable that a conductive adhesive be used as the adhesive.

[An Electrophotographic Image Forming Apparatus]

Figure 5:
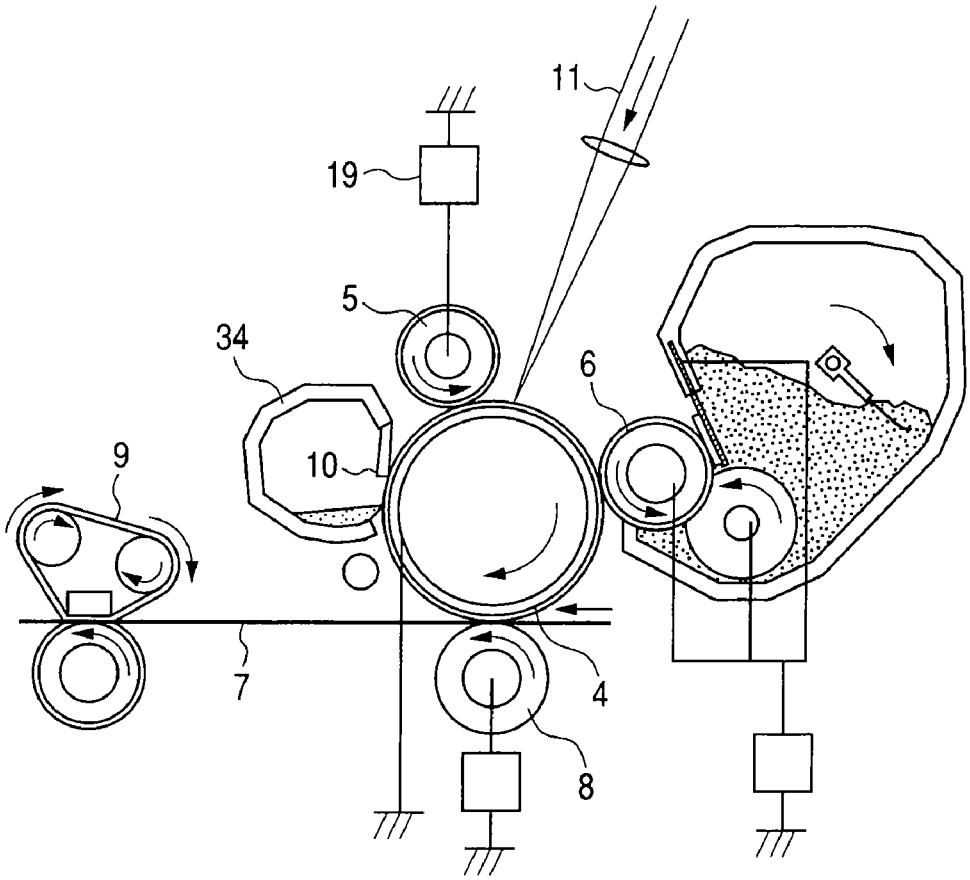
FIG. 5 is a schematic configuration diagram illustrating an example of an electrophotographic apparatus according to the present invention.

FIG. 5 illustrates a cross section of an electrophotographic apparatus including a charging roller 5 according to the present invention. An electrophotographic photosensitive member 4 rotates at a predetermined circumferential speed (process speed) in the direction of an arrow. The charging roller 5 contacts the electrophotographic photosensitive member 4 at a predetermined pressing pressure. The charging roller 5 rotates following rotation of the electrophotographic photosensitive member 4. Then, the electrophotographic photosensitive member 4 is charged at a predetermined potential by applying a predetermined direct current voltage to the charging roller 5 from a power source 19. The charged electrophotographic photosensitive member 4 is irradiated with a laser beam 11 modulated according to image information so that an electrostatic latent image is formed. The electrostatic latent image is developed by a developing roller 6 disposed in contact with the electrophotographic photosensitive member 4. A transfer unit has a transfer roller 8 of a contact type. A toner image is transferred from the electrophotographic photosensitive member 4 to a transfer material 7 such as plain paper. A cleaning unit has a cleaning blade 10 and a collection container 34. Transfer residual toner that remains on the electrophotographic photosensitive member 4 is scraped off by the cleaning blade, and is collected into the collection container 34. The cleaning blade 10 and the collection container 34 can be eliminated by collecting the transfer residual toner by a developing unit. A fixing unit 9 is composed of a heated roll or the like to fix a transferred toner image onto the transfer material 7. The electrophotographic apparatus according to the present invention is preferably configured so as to apply only direct current voltage to the charging member thereby to charge the electrophotographic photosensitive member.

[A Process Cartridge]

Figure 6:
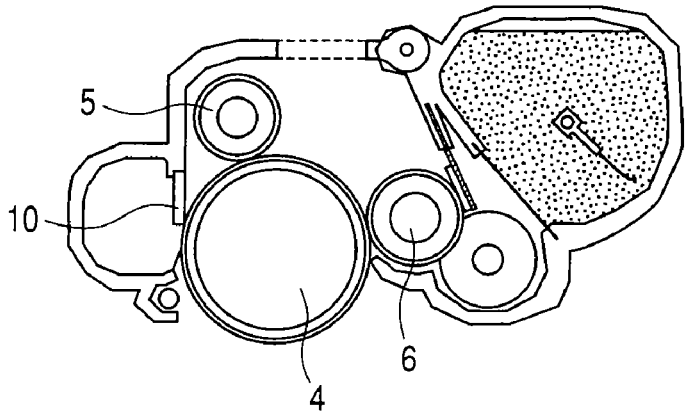
FIG. 6 is a schematic configuration diagram illustrating an example of a process cartridge according to the present invention.

FIG. 6 illustrates a cross section of a process cartridge on which the charging roller 5 and the electrophotographic photosensitive member 4 according to the present invention are mounted in contact with each other. The process cartridge is configured so as to be detachably mountable to the body of an electrophotographic apparatus. The process cartridge illustrated in FIG. 4 further includes the developing roller 6, the cleaning blade 10, and the like.

EXAMPLES

The charging member according to the present invention will be specifically described below in detail.

Synthesis Example 1

[Production of Resin Particle 1]

The following were placed into an autoclave of 4 L whose inside was replaced with nitrogen gas, and were mixed.

| Polyether polyol | |
|---|---|
| (Trade name) ADEKA POLYETHER G-300, made by ADEKA CORPORATION | 170 g |
| (Trade name) ADEKA POLYETHER P-1000, made by ADEKA CORPORATION | 690 g |
| Hexamethylene diisocyanate | 1000 g |

The inside of the autoclave was further sufficiently replaced with nitrogen. Then, the mixture was allowed to react at a temperature of 120° C. for 20 hours while the mixture was stirred. Subsequently, unreacted hexamethylene diisocyanate was removed under reduced pressure. Then, toluene was added to obtain an isocyanate prepolymer synthesized product having a nonvolatile content of 90 mass %. Next, 100 g of the isocyanate prepolymer synthesized product and the following were added into water including calcium phosphate. While the solution was stirred at 3.0 m/second, the temperature of the solution was raised over one and a half hours to 80° C. (polymerization starting temperature).

| | |
|---|---|
| Dimethylpolysiloxane having kinetic viscosity of 130 $mm^2$/second | 1 g |
| Carbon black (trade name #75: made by Asahi Carbon Co., Ltd.) | 5 g |
| Silica powder SS-50 (trade name: made by TOSOH CORPORATION) | 5 g |

Next, 5 g of pentane was added over approximately 60 minutes, and subsequently the temperature of the obtained solution was raised over 6 hours to 115° C. The solution was held as it was at 115° C. for 5 hours, and subsequently cooled over approximately 6 hours to 30° C. The obtained suspension was dispersed at a peripheral speed of 5 m/second for 20 hours using a ready mill dispersing machine filled with zirconia beads having an diameter of 0.5 μm. Next, the content was extracted and dehydrated by a centrifugal separator, and then, was washed with diethylether, and dried by a vacuum dryer, followed by classification, to thereby obtain Resin Particle 1 having one depressed portion.

Synthesis Example 2

[Production of Resin Particle 2]

In the production of Resin Particle 1, the amount of "ADEKA POLYETHER G-300" was changed to 190 g, and the amount of "ADEKA POLYETHER P-1000" was changed to 590 g. Except that, the process was performed in the same manner as in the case of production of Resin Particle 1, and an isocyanate prepolymer synthesized product was obtained. Next, 100 g of the obtained isocyanate prepolymer synthesized product and the following were added into water including calcium phosphate. While the solution was stirred at 2.5 m/second, the temperature of the solution was raised over one and a half hours to 80° C. (polymerization starting temperature).

| | |
|---|---|
| Polyisoprene having kinetic viscosity of 200 $mm^2$/second | 1 g |
| Carbon black #75 (made by Asahi Carbon Co., Ltd.) | 10 g |
| Silica powder SS-50 (made by TOSOH CORPORATION) | 20 g |

Next, 5 g of pentane was added over approximately minutes, and subsequently the temperature of the obtained solution was raised over 6 hours to 115° C. The solution was held as it was at 115° C. for 5 hours, and subsequently cooled over approximately 6 hours to 30° C. After cooling, the content was extracted, and dehydrated by a centrifugal separator, and then, was washed with diethylether, and dried by a vacuum dryer, followed by classification, to thereby obtain Resin Particle 2 having one depressed portion.

Synthesis Example 3

[Production of Resin Particle 3]

1000 g of water and 25 g of sodium dodecyl sulfate were added to a glass container of 20 L, and mixed with the following, and heated to 50° C. while being stirred at 5 m/second.

| | |
|---|---|
| α,ω-dihydroxypolydimethylsiloxane (viscosity of 85 mPa · s) | 170 g |
| Methyltrimetoxysilane | 15 g |
| Carbon black (trade name: #75, made by Asahi Carbon Co., Ltd.) | 40 g |
| Silica powder (trade name: ss-50, made by TOSOH CORPORATION) | 20 g |
| Adduct of hexamethylene diisocyanate (trade name: D160N, made by Mitsui Takeda Chemicals, Inc.) | 20 g |

Next, 10 g of a 10% titanium tetrapropoxide solution in isopropyl alcohol was added and stirred for one hour. After that, 100 g of a 10% hexaethylenediamine aqueous solution was added, and reaction was performed for hours. The obtained suspension was dispersed at a rotational speed of 5 m/second for 20 hours using a Visco Mill dispersing machine filled with zirconia beads having diameter of 0.5 μm. The dispersion liquid was dehydrated and washed by a centrifugal separator, and dried by a vacuum dryer, followed by classification, to thereby obtain Resin Particle 3 having one depressed portion.

Synthesis Example 4

[Production of Resin Particle 4]

The following were mixed in an autoclave of 2 L whose inside was replaced with nitrogen gas.

| Polyether polyol | |
|---|---|
| (trade name) ADEKA POLYETHER G-300, made by ADEKA CORPORATION | 235 g |
| (trade name) ADEKA POLYETHER P-1000, made by ADEKA CORPORATION | 365 g |
| Hexamethylene diisocyanate | 1000 g |

Further, upward displacement with nitrogen gas was fully performed, followed by sealing, and stirring and mixing were carried out for 20 hours at 120° C. to perform reaction. Subsequently, unreacted hexamethylene diisocyanate was removed under reduced pressure. Then, toluene was added to obtain an isocyanate prepolymer synthesized product having a nonvolatile content of 90 mass %. Next, 100 g of the obtained isocyanate prepolymer synthesized product and the following were added into water including calcium phosphate. While the solution was stirred at 1.5 m/second, the temperature of the solution was raised over 6 hours to 115° C. The solution was held as it was at 115° C. for 5 hours, and subsequently cooled over approximately 6 hours to 30° C.

| | |
|---|---|
| Carbon black #75 (made by Asahi Carbon Co., Ltd.) | 10 g |
| Silica powder SS-50 (made by TOSOH CORPORATION) | 3 g |

After cooling, the content was extracted, and dehydrated by a centrifugal separator, and then, was washed with pure water, and dried by a vacuum dryer, followed by classification, to thereby obtain Resin Particle 4 having no depressed portion.

Synthesis Example 5

[Production of Resin Particle 5]

In the production of Resin Particle 1, the amount of "ADEKA POLYETHER G-300" was changed to 150 g, and the amount of "ADEKA POLYETHER P-1000" was changed to 790 g. Except that, the process was performed in the same manner as in the case of production of Resin Particle 1, and an isocyanate prepolymer synthesized product was obtained. Next, 100 g of the above-mentioned isocyanate prepolymer synthesized product and the following were added into water including calcium phosphate. While the solution was stirred at 4.0 m/second, the temperature of the solution was raised over one and a half hours to 80° C. (polymerization starting temperature).

| | |
|---|---|
| Dimethylpolysiloxane having kinetic viscosity of 130 $mm^2$/second | 1 g |
| Carbon black #75 (made by Asahi Carbon Co., Ltd.) | 10 g |
| Silica powder SS-50 (made by TOSOH CORPORATION) | 3 g |

Next, 30 g of pentane was added over approximately minutes, and subsequently the temperature of the obtained solution was raised over 6 hours to 100° C. The solution was held as it was at 100° C. for 5 hours, and subsequently cooled over approximately 6 hours to 30° C. After cooling, the content was extracted, and dehydrated by a centrifugal separator, and then, was washed with diethylether, and dried by a vacuum dryer, followed by classification, to thereby obtain Resin Particles 5 each having one depressed portion.

Synthesis Example 6

[Production of Resin Particle 6]

100 g of the isocyanate prepolymer synthesized in Synthesis Example 1 and the following were added into water including calcium phosphate. While the solution was stirred at 3.0 m/second, the temperature of the solution was raised over one and a half hours to 80° C. (polymerization starting temperature).

| | |
|---|---|
| Dimethylpolysiloxane having kinetic viscosity of 130 $mm^2$/second | 1 g |
| Carbon black #75 (made by Asahi Carbon Co., Ltd.) | 10 g |

Next, 5 g of pentane was added over approximately 60 minutes, and subsequently the temperature of the obtained solution was raised over 6 hours to 115° C. The solution was held as it was at 115° C. for 5 hours, and subsequently cooled over approximately 6 hours to 30° C. After cooling, the content was extracted, and dehydrated by a centrifugal separator, and then, was washed with diethylether, and dried by a vacuum dryer, followed by classification, to thereby obtain Resin Particles 6 each having one depressed portion.

Synthesis Example 7

[Production of Resin Particle 7]

100 g of the isocyanate prepolymer synthesized product produced in Synthesis Example 4 was added into water including magnesium carbonate. While the solution was stirred at 1.5 m/second, the temperature of the solution was raised over 6 hours to 115° C. The solution was held as it was at 115° C. for 5 hours, and subsequently cooled over approximately 6 hours to 30° C. After cooling, the content was extracted, and dehydrated by a centrifugal separator, and then, was washed using pure water, and dried by a vacuum dryer, followed by classification, to thereby obtain Resin Particle 7 having no depressed portion.

Synthesis Example 8

[Production of Resin Particle 8]

1000 g of water and 25 g of sodium dodecyl sulfate were placed into a glass container of 20 L, and mixed with the following, and heated at 50° C. while being stirred at 5 m/second.

| | |
|---|---|
| α,ω-dihydroxypolydimethylsiloxane (viscosity of 85 mPa · s) | 170 g |
| Methyltrimetoxysilane | 30 g |
| Carbon black #75 (made by Asahi Carbon Co., Ltd.) | 40 g |
| Adduct of hexamethylene diisocyanate (trade name: D160N, made by Mitsui Takeda Chemicals, Inc.) | 20 g |

Next, 10 g of a 10% titanium tetraopropoxide solution in isopropyl alcohol was added and stirred for 1 hour. After that, 100 g of a 10% hexaethylenediamine aqueous solution was added, and reaction was performed for hours. The obtained suspension was dispersed at a rotational speed of 5 m/second for 20 hours using a Visco Mill dispersing machine filled with zirconia beads having a diameter of 0.5 μm. The dispersion liquid was dehydrated by a centrifugal separator. The dehydrated product was washed and dried by a vacuum dryer, followed by classification, to thereby obtain Resin Particle 8 having one depressed portion.

Synthesis Example 9

[Production of Resin Particle 9]

In Synthesis Example 8, "carbon black" was not mixed and the amount of "adduct of hexamethylene diisocyanate" was changed to 5 g. Except that, the process was performed in the same manner as in the case of Synthesis Example 8, to thereby obtain Resin Particle 9 having one depressed portion.

Synthesis Example 10

[Production of Resin Particle 10]

The following materials were added into water including calcium phosphate. While the solution was stirred at 1.5 m/second, the temperature of the solution was raised over one and a half hours to 80° C. (polymerization starting temperature).

| | |
|---|---|
| Intermediate product of isocyanate prepolymer synthesized product in production of Resin Particle 6 | 100 g |
| Dimethylpolysiloxane having kinematic viscosity of 130 $mm^2$/second | 1 g |

Next, 15 g of pentane was added over approximately minutes, and subsequently the temperature of the obtained solution was raised over 6 hours to 100° C. The solution was held as it was at 100° C. for 5 hours, and subsequently cooled over approximately 6 hours to 30° C. After cooling, the content was extracted, and dehydrated by a centrifugal separator, and then, was washed with diethylether, and dried by a vacuum dryer, followed by classification, to thereby obtain Resin Particle 10 having one depressed portion.

Synthesis Example 11

[Production of Resin Particle 11]

In Synthesis Example 10, the materials added into water including calcium phosphate were replaced with the followings.

| | |
|---|---|
| Isocyanate prepolymer synthesized product concerning Synthesis Example 6 | 100 g |
| Dimethylpolysiloxane having kinematic viscosity of 130 $mm^2$/second | 2 g |

Moreover, the amount of pentane was 3 g. As the reaction conditions, the temperature of the obtained solution was raised over 6 hours to 115° C. The solution was held as it was at 115° C. for 5 hours, and subsequently cooled over approximately 6 hours to 30° C. Except that, the process was performed in the same manner as in the case of Synthesis Example 10, to thereby obtain Resin Particle 11 having one depressed portion.

Synthesis Example 12

[Production of Resin Particle 12]

In Synthesis Example 11, the iocyanate prepolymer was replaced with the isocyanate prepolymer according to Synthesis Example 1. In addition, the amount of pentane was changed to 5 g. Except that, the process was performed in the same manner as in the case of Synthesis Example 11, to thereby obtain Resin Particle 12 having one depressed portion.

Synthesis Example 13

[Production of Resin Particle 13]

The following materials were placed into a glass container of 20 L, and mixed by nitrogen bubbling.

| | |
|---|---|
| Polyvinyl alcohol | 20 g |
| Water | 5000 g |
| Ethylenediaminetetraacetic acid sodium | 2 g |

In a nitrogen atmosphere, the following materials were added to the resulting mixture to be suspended, and held at 10° C.

| | |
|---|---|
| Stearylacrylate | 78 g |
| Butyl acrylate | 84 g |
| Ethylene glycol dimethacrylate | 2.3 g |
| Styrene | 35 g |
| Glycerol stearate | 0.3 g |

While this mixture was stirred at 3.5 m/second, the temperature of the mixture was raised to 100° C. Then, 2 g of t-butyl hydroperoxide and 18 g of methylheptane were added, and reaction was performed for 7 hours. The obtained suspension was dispersed at a rotational speed of 5 m/second for 20 hours using a ready mill dispersing machine filled with zirconia beads having a diameter of 0.5 μm. The dispersion liquid was dehydrated and washed by a centrifugal separator, and dried by a vacuum dryer, followed by classification, to thereby obtain Resin Particle 13 having one depressed portion.

Synthesis Example 14

[Production of Resin Particle 14]

100 g of the isocyanate prepolymer synthesized product according to Synthesis Example 1 was added into water including magnesium pyrophosphate. While the solution was stirred at 1.5 m/second, the temperature of the solution was raised over 6 hours to 115° C. The solution was held as it was at 115° C. for 5 hours. Subsequently, the solution was cooled over approximately 6 hours to 30° C. After cooling, the content was extracted, and dehydrated by a centrifugal separator, and then, was washed with pure water, and dried by a vacuum dryer, followed by classification, to thereby obtain Resin Particle 14 having no depressed portion.

Synthesis Example 15

[Production of Resin Particle 15]

In Synthesis Example 13, the amount of "ethylene glycol dimethacrylate" was changed to 2.1 g. In addition, the stirring speed was changed to 2.5 m/second, the reaction temperature was changed to 80° C., and the amount of methyl heptane was changed to 20 g. Except that, the process was performed in the same manner as in the case of Synthesis Example 13, to thereby obtain Resin Particle 15 having one depressed portion.

Synthesis Example 16

[Production of Resin Particle 16]

In Synthesis Example 12, the amount of dimethylpolysiloxane was changed to 3 g, and the stirring speed was changed to 2.5 m/second. In addition, the amount of pentane was changed to 15 g. Except that, the process was performed in the same manner as in the case of Synthesis Example 12, to thereby obtain Resin Particle 16 having one depressed portion.

Synthesis Example 17

[Production of Resin Particle 17]

In Synthesis Example 13, 84 g of "butyl acrylate" was replaced with 65 g of "ethyl acrylate". In addition, the amount of glycerol stearate was changed to 0.1 g. Further, the amount of methyl heptane was changed to 8 g. Except that, the process was performed in the same manner as in the case of Synthesis Example 13, to thereby obtain Resin Particle 17 having one depressed portion.

Synthesis Example 18

[Production of Resin Particle 18]

In Synthesis Example 13, the amount of "ethylene glycol dimethacrylate" was changed to 2.4 g, the amount of "glycerol stearate" was changed to 0.5 g, and the amount of "methyl heptane" was changed to 30 g. Further, the stirring speed was changed to 4.0 m/second. Except that, the process was performed in the same manner as in the case of Synthesis Example 13, to thereby obtain Resin Particle 18 having one depressed portion.

Synthesis Example 19

[Production of Resin Particle 19]

In Synthesis Example 14, the reaction temperature was changed to 125° C. Except that, the process was performed in the same manner as in the case of Synthesis Example 14, to thereby obtain Resin Particle 19 having no depressed portion.

Synthesis Example 20

[Production of Resin Particle 20]

In Synthesis Example 12, 2 g of "dimethylpolysiloxane" was changed to 3 g of "polyisoprene having kinetic viscosity of 200 $mm^2$/second". In addition, the amount of "pentane" was changed to 10 g. Except that, the process was performed in the same manner as in the case of Synthesis Example 12, to thereby obtain Resin Particle 20 having one depressed portion.

Synthesis Example 21

[Production of Resin Particle 21]

In Synthesis Example 13, the amount of "ethylene glycol dimethacrylate" was changed to 2.6 g, and the amount of "pentane" was changed to 30 g. Moreover, the stirring speed was changed to 2.5 m/second, and the reaction temperature was changed to 60° C. Except that, the process was performed in the same manner as in the case of Synthesis Example 13, to thereby obtain Resin Particle 21 having one depressed portion.

Synthesis Example 22

[Production of Resin Particle 22]

In Synthesis Example 13, 84 g of "butyl acrylate" was replaced with 70 g of "propylacrylate," and the amount of "ethylene glycol dimethacrylate" was changed to 2.6 g. In addition, the stirring speed was changed to 4.0 m/second, the reaction temperature was changed to 80° C., and the amount of "pentane" was changed to 30 g. Except those, the process was performed in the same manner as in the case of Synthesis Example 13, to thereby obtain Resin Particle 22 having one depressed portion.

Synthesis Example 23

[Production of Resin Particle 23]

100 g of the isocyanate prepolymer synthesized product, which was an intermediate product in the production of Resin Particle 1, and 3 g of polyisoprene having kinematic viscosity of 200 $mm^2$/second were added into water including magnesium pyrophosphate. While the solution was stirred at 1.5 m/second, the temperature of the solution was raised to 80° C. (polymerization starting temperature). Next, 15 g of pentane was added over approximately 60 minutes, and subsequently the temperature of the obtained solution was raised over 6 hours to 110° C. The solution was held as it was at 110° C. for 5 hours, and subsequently cooled over approximately 6 hours to 30° C. After cooling, the content was extracted, and dehydrated by a centrifugal separator, and then, was washed with diethylether, and dried by a vacuum dryer, followed by classification, to thereby obtain Resin Particle 23 having one depressed portion.

Synthesis Example 24

[Production of Resin Particle 24]

In Synthesis Example 16, the amount of "polyisoprene having kinetic viscosity of 200 $mm^2$/second" was changed to 4 g, and the stirring speed was changed to 1.5 m/second. Moreover, the reaction temperature after adding "pentane" was changed to 110° C. Except those, the process was performed in the same manner as in the case of Synthesis Example 16, to thereby obtain Resin Particle 24 having one depressed portion.

Synthesis Example 25

[Production of Resin Particle 25]

In Synthesis Example 13, the amount of "styrene" was changed to 15 g, the stirring speed was changed to 4.0 m/second, and the reaction temperature was changed to 60° C. Moreover, 18 g of "methyl heptane" was replaced with 25 g of "pentane." Except those, the process was performed in the same manner as in the case of Synthesis Example 13, to thereby obtain Resin Particle 25 having one depressed portion.

Synthesis Example 26

[Production of Resin Particle 26]

In Synthesis Example 13, 84 g of "butyl acrylate" was replaced with 70 g of "propylacrylate." Moreover, the amount of "ethylene glycol methacrylate" was changed to 2.6 g, and the amount of "glycerol stearate" was changed to 0.1 g. Further, the stirring speed was changed to 2.0 m/second, and the amount of "methyl heptane" was changed to 10 g. Except those, the process was performed in the same manner as in the case of Synthesis Example 13, to thereby obtain Resin Particle 26 having one depressed portion.

Synthesis example 27

[Production of Resin Particle 27]

100 g of the isocyanate prepolymer synthesized product in Synthesis Example 1 was added into water including calcium phosphate. While the solution was stirred at 2.5 m/second, the temperature of the solution was raised over 6 hours to 115° C. The solution was held as it was at 115° C. for 5 hours, and subsequently cooled over approximately 6 hours to 30° C. After cooling, the content was extracted, and dehydrated by a centrifugal separator, and then, was washed with pure water, and dried by a vacuum dryer, followed by classification, to thereby obtain Resin Particle 27 having no depressed portion.

Synthesis Example 28

[Production of Resin Particle 28]

In Synthesis Example 16, the stirring speed was changed to 4.0 m/second. Except that, the process was performed in the same manner as in the case of Synthesis Example 16, to thereby obtain Resin Particle 28 having one depressed portion.

Synthesis Example 29

[Production of Resin Particle 29]

In Synthesis Example 23, the amount of "polyisoprene" was changed to 4 g. Moreover, the amount of "pentane" was changed to 25 g. Except those, the process was performed in the same manner as in the case of Synthesis Example 23, to thereby obtain Resin Particle 29 having one depressed portion.

Synthesis Example 30

[Production of Resin Particle 30]

In Synthesis Example 13, "butyl acrylate" was replaced with "ethyl methacrylate." The amount of ethylene glycol dimethacrylate was changed to 2.8 g, the amount of styrene was changed to 40 g, and the amount of glycerol stearate was changed to 0.1 g. Further, the stirring speed was changed to 2.5 m/second, and the amount of "methyl heptane" was changed to 10 g. Except those, the process was performed in the same manner as in the case of Synthesis Example 13, to thereby obtain Resin Particle 30 having one depressed portion.

Synthesis Example 31

[Production of Resin Particle 31]

In Synthesis Example 24, the stirring speed was changed to 3.0 m/second, and the amount of "pentane" was changed to 2 g. Except those, the process was performed in the same manner as in the case of Synthesis Example 24, to thereby obtain Resin Particle 31 having one depressed portion.

Synthesis Example 32

[Production of Resin Particle 32]

In Synthesis Example 24, the stirring speed was changed to 1.8 m/second, and the amount of "pentane" was changed to 10 g. Except those, the process was performed in the same manner as in the case of Synthesis Example 24, to thereby obtain Resin Particle 32 having one depressed portion.

Synthesis Example 33

[Production of Resin Particle 33]

In Synthesis Example 13, the amount of "butyl methacrylate" was changed to 70 g, the amount of "ethylene glycol dimethacrylate" was changed to 2.6 g, and the amount of "glycerol stearate" was changed to 0.1 g. Moreover, the stirring speed was changed to 4.5 m/second, and the reaction temperature was changed to 80° C. Further, 10 g of octane was used instead of 18 g of "methyl heptane." Except those, the process was performed in the same manner as in the case of Synthesis Example 13, to thereby obtain Resin Particle 33 having one depressed portion.

Synthesis Example 34

[Production of Resin Particle 34]

In Synthesis Example 13, the amount of "ethylene glycol dimethacrylate" was changed to 2.6 g, and the amount of "glycerol stearate" was changed to 0.5 g. The stirring speed was changed to 2.0 m/second, and the reaction temperature was changed to 30° C. Moreover, 45 g of "heptane" was used instead of 18 g of "methyl heptane." Except those, the process was performed in the same manner as in the case of Synthesis Example 13, to thereby obtain Resin Particle 34 having one depressed portion.

Synthesis Example 35

[Production of Resin Particle 35]

In Synthesis Example 27, the stirring speed was changed to 3.0 m/second. Except that, the process was performed in the same manner as in the case of Synthesis Example 27, to thereby obtain Resin Particle 35 having one depressed portion.

Synthesis Example 36

[Production of Resin Particle 36]

In Synthesis Example 13, the amount of "stearylacrylate" was changed to 40 g, the amount of "ethylene glycol dimethacrylate" was changed to 15 g, the amount of "glycerol stearate" was changed to 0 g, and the amount of "methyl heptane" was changed to 0 g. Except those, the process was performed in the same manner as in the case of Synthesis Example 13, to thereby obtain Resin Particle 36 having no depressed portion.

Synthesis Example 37

[Production of Resin Particle 37]

15 g of polyvinyl alcohol having a saponification degree of 88% was dispersed into 1500 g of water in a glass container of 20 L to obtain a dispersion liquid. Moreover, a liquid was prepared in which 20 g of a trimethylolpropane adduct of tolylene diisocyanate (CORONATE L: made by Nippon Polyurethane Industry Co., Ltd.) was dissolved in 15 g of toluene. This solution and the above-mentioned dispersion liquid were mixed and dispersed to obtain an emulsified liquid. 3 L of this emulsified liquid was placed into another glass container, and heated at 70° C. to perform the reaction for 3 hours. The dispersion liquid was dehydrated and washed by a centrifugal separator, and dried by a vacuum dryer. The obtained particles were classified to obtain Resin Particle 37 that was hollow microcapsules having an average particle size of 15 μm.

Synthesis Example 38

[Production of Conductive Particles]

140 g of methyl hydrogen polysiloxane was added to 7.0 kg of silica as metal oxide particles (average particle size of 15 nm, volume resistivity of $1.8\times10^{12}\Omega\cdot$cm) while an edge-runner was operated. Mixing and stirring were performed for 30 minutes under the operating conditions of a line load of 588 N/cm (60 kg/cm) and a stirring speed of 22 rpm. Next, while the edge-runner was operated, 7.0 kg of carbon black particles (particle size of 28 nm, volume resistivity of 1.0×102Ω·cm, pH 6.5) were added over 10 minutes. Further, mixing and stirring was performed for 60 minutes in a line load of 588 N/cm (60 kg/cm), and carbon black was added to cover methyl hydrogen polysiloxane. Subsequently, the product was dried for 60 minutes at 80° C. using a dryer so that conductive complex particulates were obtained. The stirring speed was 22 rpm. The obtained conductive particulates had an average particle size of 15 nm and a volume resistivity of $2.3\times10^{2}\Omega\cdot$cm.

Synthesis Example 39

[Production of Titanium Oxide Particles]

1000 g of needle-like rutile type titanium oxide particles (average particle size of 15 nm, length: width=3:1, volume resistivity of $5.2\times10^{10}\Omega\cdot$cm), 110 g of isobutyl trimethoxysilane as a surface treating agent, and 3000 g of toluene as a solvent were mixed to prepare a slurry. This slurry was mixed for 30 minutes by a stirrer. Subsequently, the slurry was supplied to a Visco Mill filled with glass beads having the average particle size of 0.8 mm in 80% of the effective content volume, and subjected to wet disintegration processing at a temperature of 35±5° C. Using a kneader, toluene was removed from the slurry obtained through wet disintegration processing by vacuum distillation (bath temperature: 110° C., product temperature: 30 to 60° C., pressure reduction degree: approximately 100 Torr). Then, baking treatment with the surface treating agent was performed at 120° C. for 2 hours. The particles thus subjected to baking treatment were cooled to room temperature, and pulverized by means of a pin mill.

Example 1

[Production of an Elastic Layer]

A mandrel made of stainless steel having a diameter of 6 mm and a length of 252.5 mm was used as a conductive support. A thermosetting adhesive (METALOC U-20: made by Toyo Kagaku Kenkyusho Co., Ltd.) was applied onto the mandrel, and dried.

Next, the following were kneaded for 10 minutes by a closed type mixer adjusted at 50° C., and a raw material compound was prepared.

| Materials | Parts by mass |
|---|---|
| Epichlorohydrin rubber ternary copolymer part<br>Ethylene oxide (EO)/epichlorohydrin (EP)/allyl glycidyl ether (AGE) = 73 mol %/23 mol %/4 mol % | 100 |
| Calcium carbonate | 60.0 |
| Aliphatic polyester plasticizer | 8.0 |
| Zinc stearate | 1.5 |
| 2-mercaptobenzimidazole (MB) (antioxidant) | 0.5 |
| Zinc oxide | 4.0 |
| Lauryl trimethyl ammonium chloride | 1.5 |
| FEF carbon black | 5.0 |

In relation to the epichlorhydrin rubber ternary polymerizer, 1 mass % of sulfur (vulcanizing agent), 1 mass % of dibenzothiazyl sulfide (DM) (vulcanization accelerator), and 0.5 mass % of tetramethylthiurammonosulfide (TS) were added to this raw material compound. The obtained mixture was kneaded for 10 minutes with a double roller cooled to 20° C., and a compound for the elastic layer was obtained. This compound for the elastic layer was extruded onto the conductive support coated with an adhesive by an extruder, and formed so as to have a roller-like shape with an outer diameter of approximately 9 mm. Next, vulcanization and hardening of the adhesive were performed at 160° C. for 1 hour using an electrical oven. Both ends of the rubber were cut off so that the rubber length was 228 mm. Subsequently, the surface having the outer diameter of 8.5 mm and the crown amount (the difference between the outer diameter of the central portion and the outer diameter at a position 90 mm away from the central portion) of 120 μm was polished and processed to produce the elastic layer.

[Production of the surface layer]

A mixed solvent of methyl isobutyl ketone and methyl ethyl ketone in a mass ratio of 1:1 was added to a caprolactone modified acrylic polyol solution. The solution was adjusted so that a solid content was 8.5 mass %, and an acrylic polyol liquid was prepared. To the solid content 100 parts by mass in the acrylic polyol liquid, the followings were added to prepare a mixed solution.

| Materials | Parts by mass |
|---|---|
| Conductive particulates (synthesized in Synthesis Example 38) | 55 |
| Titanium oxide particles (synthesized in Synthesis Example 39) | 30 |
| Modified dimethyl silicone oil | 0.08 |
| Mixture of butanone oxime-blocked hexamethylene diisocyanate (HDI) and butanone oxime-blocked isophorone diisocyanate (IPDI) of 7:3* | 80.14 |

*The mixture of blocked HDI and blocked IPDI is added so as to be "NCO/OH = 1.0."

420 g of the above-mentioned mixed solution and 200 g of glass beads having an average particle size of 0.8 mm as a medium were mixed in a glass bottle of 450 mL. Then, first dispersion was performed for 24 hours using a paint shaker dispersing machine. After dispersion, 5.16 parts by mass of Resin Particle 1 (amount equivalent to 20 parts by mass with respect to 100 parts by weight of acrylic polyol) was added. Then, second dispersion was performed for 30 minutes to obtain a coating solution for surface layer formation. This coating solution for surface layer formation was applied onto the obtained elastic layer once by dipping, and air-dried at normal temperature for not less than 30 minutes, and was dried for 1 hour with a hot air circulation dryer set at 90° C., and further dried for 1 hour with a hot air circulation dryer set at 160° C. Adjustment was performed so that dipping time was 10 seconds, and pulling-up velocity was initially 15 mm/s and finally 1 mm/s. Between 15 mm/s to 1 mm/s, the velocity was linearly changed with respect to time. Thus, the surface layer was formed on the elastic layer, and Charging Member 1 was obtained. This charging member 1 was left standing for not less than 24 hours in an N/N (normal temperature and normal humidity: 23° C./55% RH) environment. Subsequently, the charging member was subjected to the following evaluation.

[Surface State]

The surface of Charging Member 1 was observed by using an optical microscope, and the shape of the depressed portions (opening diameter, opening depth) of the protrusions on the surface layer resulting from the resin particles according to the present invention, a proportion of the protrusions each having a depressed portion, and a particle size, an opening ratio, and hardness of the resin particles that form the protrusions were determined.

The opening diameter 54 and the maximum depth 53 of the depressed portion 52 that the protrusion 51 of the surface layer has are calculated by the following method. First, for ten positions on the surface selected at random in the longitudinal direction of the charging member, image data on a three-dimensional shape within a visual field (0.5 mm×0.5 mm) are obtained by using a laser beam microscope (trade name LSM5 PASCAL; made by Carl Zeiss). The maximum projected area of the depressed portion 52 formed at the peak of one protrusion 51 within the visual field was calculated using the obtained image data. A circle-equivalent diameter is calculated on the basis of the maximum projected area. This is defined as the opening diameter of one depressed portion 52. Moreover, the distance between the maximum protrusion plane of the depressed portion 52 contacting the bottom of the depressed portion 52 and the maximum protrusion plane of the depressed portion 52 contacting the edge of the depressed portion 52 is calculated. This is defined as the maximum depth of one depressed portion 52. The above-mentioned work is performed for ten protrusions 51 within the same visual field. The arithmetic mean value of the opening diameters of 100 depressed portions 52 and the arithmetic mean value of the maximum depths of 100 depressed portions 52 thus obtained are defined as the opening diameter 54 and maximum depth 53 of one charging member.

As for the proportion of the number of the protrusions each having the depressed portions at the peak among the protrusions formed on the surface of the surface layer, 120 of the protrusions resulting from the resin particles 58 were selected at random from the data on the three-dimensional shape obtained above. Then, among those protrusions, the number of the protrusions in which the depressed portions 52 resulting from the depressed portions 55 of the resin particles 58 were formed was counted. This work was performed for each measurement position to determine the number of the protrusions having the depressed portions 52 in 1200 protrusions in total resulting from the resin particles 58. This was defined as the proportion of the number of the protrusions each having the depressed portion at the peak among the protrusions formed on the surface of the surface layer in one charging member.

The opening ratio of the depressed portions 55 of the resin particles 58 in the surface layer was calculated by the following method. Ten positions on the surface selected at random in the longitudinal direction of the charging member are cut over 500 μm by every 20 nm by means of a focused ion beam "FB-2000C" (made by Hitachi, Ltd.). The cross section images are photographed. Then, an image obtained by photographing the same resin particle 58 is combined with the cross section images to determine a stereoscopic image of the resin particle 58. Based on this stereoscopic image, the opening ratio of the resin particle 58 having the depressed portion 55 is calculated. As for the opening diameter of the depressed portion 55, the circle-equivalent diameter is calculated on the basis of the maximum projected area of the depressed portion 55, and defined as the opening diameter 57. The circle-equivalent diameter is calculated based on the maximum projected area of the resin particle 58, and defined as the particle size 56. The opening ratio is determined by dividing the obtained opening diameter by the obtained particle size. This work is performed for ten resin particles each cut at the same position. The arithmetic mean value of the particle sizes of 100 resin particles 58 in total and the arithmetic mean value of the opening diameters of 100 resin particles 58 in total thus obtained are defined as the particle size and the opening ratio of the resin particles in one charging member.

As the hardness of the resin particle 58, a measured value according to the following measurement method was used. As a measurement apparatus, a Nano Indenter (trade name; made by MTS Systems Corporation) was used. Measurement conditions were as follows: head for indentation test: DCM, test mode: CSN (Continuous Stiffness Measurement), and indenter: Berkovich type diamond indenter. Measurement parameters were as follows:

Allowable Drift Rate 0.05 nm/s;
Frequency Target 45.0 Hz;
Harmonic Displacement Target 1.0 nm;
Strain Rate Target 0.05 l/S; and
Depth Limit 2000 nm.

As for a specific measurement method, in the first place, a small piece of the surface layer (5 mm long, 5 mm wide, and 3 mm thick) is cut out of the surface layer with a razor. The resin particle 58 in this small piece is observed with an optical microscope (100 magnifications). The resin particle 58 is cut approximately at its center by a razor, and the cross section of the resin particle is observed. The hardness of the resin particle is hardness in the cross section. The resin particles whose hardness were measured had diameters within the range of from 90% to 110% of the average particle size found from the circle-equivalent diameters calculated on the basis of the cross section areas of the resin particles. This measurement was performed for 100 composite particles, and the arithmetic mean of the measured values was calculated.

[Microhardness of the surface layer]

A microhardness tester MD-1 type (made by KOBUNSHI KEIKI Co., Ltd.) was used for measurement of microhardness. Measurement was performed in a peak hold mode in a 23° C./55% environment. The result is shown in Table 3.

[Thickness of the surface layer]

As for the thickness of the surface layer, the cross sections of the surface layer at nine positions in total (three positions in the axis direction for each of three positions in the circumferential direction) were observed and measured by using an optical microscope, and the average value of the measured values was employed.

[Surface Roughness of the Charging Member]

The ten-point average roughness Rz and the average irregularity distance Sm of the surface were measured based on Japanese Industrial Standard (JIS) B 0601-1994. Measurement was performed using a surface roughness measuring instrument (trade name: SE-3500, made by Kosaka Laboratory Ltd.). Rz is represented by an arithmetic mean value of Rz's in six positions selected at random on the surface of the charging member. Moreover, Sm is an arithmetic mean value of Sm (average distance of irregularities) in six positions selected at random on the surface of the charging member. In the measurement of Rz and Sm, a cutoff value was 0.8 mm, an evaluation length was 8 mm, and as a cutoff filter, a Gaussian filter was used.

[Electric Resistance of the Charging Member]

Figure 4:
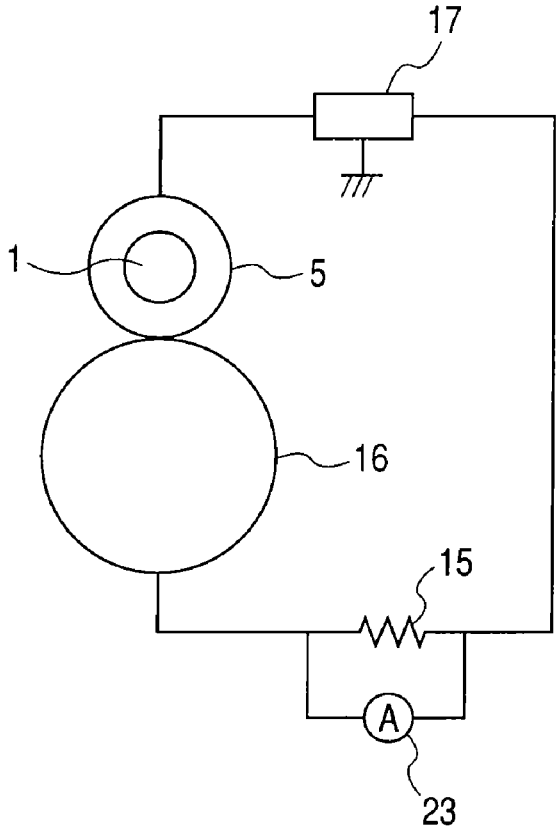
FIG. 4 is a schematic configuration diagram illustrating a measurement apparatus to measure the electric resistance of the charging member according to the present invention.

In measurement of electric resistance, as illustrated in FIG. 4, a shaft 1 is supported on both sides of the charging member by bearings (not illustrated) to which a load is applied. The charging member is disposed in parallel with a columnar metal 16 having the same curvature as the photosensitive member, and brought into contact with the cylindrical shape metal 16. The columnar metal 16 is rotated by a motor (not illustrated). Following the rotation, the charging member is rotated while contacting the columnar metal. A direct current voltage of 200 V is applied from a power source 17, and a current flowing into a resistance 15 is measured by an ammeter 23, and from the measured value, the resistance of the charging member was calculated. The force applied to each of both sides of the shaft of the charging member was 5 N, the diameter of the metal column was 30 mm, and the peripheral speed of rotation was 45 mm/sec.

[Image Evaluation]

A contamination adhesion accelerated test was performed for the obtained charging member 1. The charging member 1 was mounted on an electrophotographic apparatus (hereinafter referred to as Evaluation Machine 1) obtained by converting a laser printer (trade name: LBP 5400, made by Canon Inc.) so as to have a process speed of 200 mm/sec. Subsequently, a solid black image is continuously output on 100 sheets in a normal temperature and normal humidity environment (25° C., 50% RH). Then, a solid white image is output on one sheet. This operation was repeated 6 times so that the black solid image was output on 600 sheets in total. Through this work, toner and an external additive were forced to adhere onto the charging member surface. Image Evaluation Test 1 and Image Evaluation Test 2 below were performed using this charging member 1.

[Image Evaluation Test 1]

Image Evaluation Test 1 was performed in a normal temperature and normal humidity environment (environment 1: temperature of 23° C., humidity of 50% RH) and a low temperature and low humidity environment (environment 2: temperature of 15° C., humidity of 10% RH). The evaluation machine 1 was used to continuously print an image having a printing density of 2% (an image composed of horizontal lines of 2 dots each in width at intervals of 5 dots in the direction perpendicular to the rotational direction of the photosensitive member) on a plurality of sheets. Then, a halftone image (an image composed of horizontal lines of 1 dot each in width at intervals of 2 dots in the direction perpendicular to the rotational direction of the photosensitive member) was output for the image evaluation at the initial stage, after 3000 sheets printing, and after 6000 sheets printing. The obtained three sheets of the halftone image were evaluated by visual observation according to the following criteria:

A: Neither striped concentration unevenness (striped image) attributed to charging unevenness nor dotted concentration unevenness (dotted image) is observed;

B: An extremely slight striped or dotted concentration unevenness is observed in some cases;

C: Striped or dotted concentration unevenness is observed in some cases; and

D: striped or dotted concentration unevenness is always observed at many places.

[Image Evaluation Test 2]

A process cartridge for an evaluation machine was converted so as to have pressing pressure by a spring of 0.8 kgf on one side and of 1.6 kgf in total on both sides. Charging Member 1 was mounted on this process cartridge, and was left standing in an environment of a temperature of 30° C. and a humidity of 80% RH for one month and in an environment of a temperature of 40° C. and a humidity of 95% for one month, respectively. Then, a halftone image (an image composed of horizontal lines of 1 dot each in width at intervals of 2 dots in the direction perpendicular to the rotational direction of the photosensitive member) was output by the use of the above-mentioned Evaluation Machine 1 for the image evaluation in an environment of a temperature of 23° C. and a humidity of 50%, and further in an environment of a temperature of 15° C. and a humidity of 10%.

Next, in each environment, an image having 2% of a printing density (an image composed of horizontal lines of 2 dots each in width at intervals of 50 dots in the direction perpendicular to the rotational direction of the photosensitive member) were continuously printed on 3000 sheets. Subsequently, the halftone image was output for the image evaluation. The obtained images were evaluated on defective images due to the C set according to the following criteria. The result is shown in the Table.

A: no striped unevenness attributed to the C set is observed in the image.

B: extremely slight striped unevenness attributed to the C set is observed in the image in some cases.

C: striped unevenness attributed to the C set thicker than Rank B may be observed in the image.

D: thick striped unevenness attributed to the C set is always observed in the image.

Examples 2 to 5

The resin particle and the amount thereof to be added to the coating solution for surface layer formation, and the dipping time into the coating solution were changed as shown in Table 1. Except that, Charging Members 2 to 5 were produced and evaluated in the same manner as in the case of Example 1.

TABLE 1

| | Resin particle No. | Amount of resin particle to be added (parts by mass) | Dipping time (seconds) |
|---|---|---|---|
| Example 2 | 2 | 2.58 | 10 |
| Example 3 | 3 | 1.29 | 13 |
| Example 4 | 4 | 1.29 | 13 |
| Example 5 | 5 | 7.74 | 10 |

Examples 6 to 35, Comparative Example 1

The resin particle and the amount thereof, and the conductive fine particles to be added to the coating solution for surface layer formation, the first dispersion time, and the dipping time were changed as shown in Table 2 below. Except that, Charging Members 6 to 36 were produced and evaluated in the same manner as in the case of Example 1.

Comparative Example 2

Resin Particle 1 added to the coating for surface layer formation was replaced with Resin Particle 37, and the dipping time was changed to 40 seconds. Except that, the surface layer was formed in the same manner as in the case of Example 1. Next, the surface layer was ground to produce Charging Member 37 having depressed portions resulting from hollow capsules, and evaluation was made. A grinding stone (made by TEIKEN Corporation; abrasive grains of green silicon carbide (JIS symbol: GC) and grain size #80, grade C, structure 20, and binder V (vitrified)) was used for grinding. As the grinding method, this grinding stone was attached to a cylindrical grinder. The surface of the surface layer was ground by 15 μm, and the protrusions resulting from Resin Particle 37 were ground and removed. The grinding conditions are as follows: a time period from the time point at which a rubber roller is brought into contact with the grinding stone to the completion: 8 seconds, the number of rotations of the grinding stone: 2050 rpm, and the number of rotations of the rubber roller: 350 rpm. In addition, an upper-cut method was used in which the direction of rotation of the grinding stone was the same as the direction of rotation of the rubber roller.

TABLE 2

| | Resin particle No. | Amount of resin particle to be added (parts by mass) | Amount of conductive particles to be added (parts by mass) | First dispersion time (hours) | Dipping time (seconds) |
|---|---|---|---|---|---|
| Example 6 | 6 | 5.16 | 50 | 20 | 17 |
| Example 7 | 7 | 1.29 | 50 | 20 | 17 |
| Example 8 | 8 | 5.16 | 50 | 20 | 12 |
| Example 9 | 9 | 5.16 | 50 | 20 | 15 |
| Example 10 | 10 | 5.16 | 50 | 20 | 15 |
| Example 11 | 11 | 5.16 | 45 | 16 | 14 |
| Example 12 | 12 | 5.16 | 45 | 16 | 15 |
| Example 13 | 13 | 2.58 | 45 | 16 | 20 |
| Example 14 | 14 | 1.29 | 45 | 16 | 5 |
| Example 15 | 15 | 1.29 | 45 | 16 | 20 |
| Example 16 | 16 | 2.58 | 45 | 16 | 5 |
| Example 17 | 17 | 2.58 | 45 | 16 | 20 |
| Example 18 | 18 | 7.74 | 45 | 16 | 20 |
| Example 19 | 19 | 1.29 | 45 | 16 | 20 |
| Example 20 | 20 | 1.29 | 45 | 16 | 5 |
| Example 21 | 21 | 1.29 | 30 | 13 | 30 |
| Example 22 | 22 | 2.58 | 28 | 13 | 30 |
| Example 23 | 23 | 1.29 | 28 | 13 | 30 |
| Example 24 | 24 | 1.29 | 28 | 13 | 10 |
| Example 25 | 25 | 12.9 | 28 | 13 | 33 |
| Example 26 | 26 | 1.29 | 28 | 13 | 33 |
| Example 27 | 27 | 2.58 | 28 | 13 | 33 |
| Example 28 | 28 | 1.29 | 28 | 13 | 10 |
| Example 29 | 29 | 0.65 | 28 | 13 | 10 |
| Example 30 | 30 | 0.65 | 28 | 13 | 33 |
| Example 31 | 31 | 5.16 | 28 | 13 | 10 |
| Example 32 | 32 | 1.29 | 28 | 13 | 33 |
| Example 33 | 33 | 5.16 | 28 | 13 | 10 |
| Example 34 | 34 | 1.29 | 28 | 13 | 10 |
| Example 35 | 35 | 5.16 | 28 | 13 | 33 |
| Comparative Example 1 | 36 | 5.16 | 28 | 13 | 33 |
| Comparative Example 2 | 37 | 5.16 | 55 | 24 | 10 |

Tables 3 to 6 below show the evaluation results of the charging members according to the above-mentioned Examples 1 to 35 and Comparative Examples 1 and 2, and the results of the image evaluation.

TABLE 3

| | Charging member surface | | | Resin partice | | |
|---|---|---|---|---|---|---|
| | Opening diameter (μm) | Opening depth (μm) | Abundance ratio of protrusions having one depressed portion (%) | Particle size (μm) | Opening ratio | Hardness ($\times 10^{-4}$N) |
| Example 1 | 2.8 | 1.3 | 98 | 10 | 0.31 | 0.1 |
| Example 2 | 4.3 | 2.0 | 90 | 14 | 0.48 | 0.3 |
| Example 3 | 4.0 | 0.8 | 98 | 18 | 0.19 | 0.5 |
| Example 4 | 1.0 | 1.9 | 98 | 20 | 0.05 | 0.3 |
| Example 5 | 0.5 | 0.8 | 91 | 5 | 0.41 | 0.1 |
| Example 6 | 3.0 | 1.5 | 90 | 10 | 0.32 | 0.3 |
| Example 7 | 4.5 | 2.0 | 98 | 35 | 0.11 | 0.3 |
| Example 8 | 3.3 | 1.1 | 98 | 18 | 0.15 | 0.5 |
| Example 9 | 2.7 | 1.8 | 99 | 15 | 0.22 | 0.5 |
| Example 10 | 1.2 | 2.0 | 87 | 20 | 0.30 | 0.1 |
| Example 11 | 3.1 | 2.0 | 95 | 21 | 0.20 | 0.1 |
| Example 12 | 4.9 | 1.9 | 80 | 20 | 0.50 | 0.05 |
| Example 13 | 0.7 | 0.6 | 90 | 14 | 0.05 | 0.7 |
| Example 14 | 2.5 | 0.8 | 99 | 25 | 0.09 | 0.05 |
| Example 15 | 4.8 | 1.8 | 98 | 22 | 0.25 | 0.6 |
| Example 16 | 3.5 | 2.0 | 82 | 15 | 0.71 | 0.05 |
| Example 17 | 0.5 | 1.9 | 82 | 16 | 0.03 | 0.7 |
| Example 18 | 5.0 | 0.5 | 81 | 11 | 0.70 | 0.7 |
| Example 19 | 0.6 | 0.6 | 95 | 25 | 0.03 | 0.05 |
| Example 20 | 4.9 | 2.0 | 70 | 19 | 0.60 | 0.8 |
| Example 21 | 4.5 | 1.7 | 72 | 18 | 0.65 | 0.8 |
| Example 22 | 4.0 | 0.6 | 65 | 11 | 0.60 | 0.8 |
| Example 23 | 3.2 | 2.0 | 60 | 25 | 0.71 | 0.05 |
| Example 24 | 2.5 | 1.8 | 66 | 20 | 0.70 | 0.05 |
| Example 25 | 2.3 | 0.5 | 65 | 8 | 0.62 | 0.8 |
| Example 26 | 0.5 | 2.0 | 70 | 25 | 0.03 | 0.8 |
| Example 27 | 0.5 | 1.5 | 95 | 15 | 0.03 | 0.05 |
| Example 28 | 0.8 | 0.5 | 65 | 5 | 0.85 | 0.05 |
| Example 29 | 3.0 | 2.1 | 80 | 25 | 0.82 | 0.05 |
| Example 30 | 0.4 | 2.0 | 85 | 21 | 0.03 | 0.8 |
| Example 31 | 5.5 | 0.5 | 85 | 10 | 0.81 | 0.05 |
| Example 32 | 6.0 | 2.1 | 65 | 18 | 0.82 | 0.05 |
| Example 33 | 6.0 | 0.3 | 60 | 8 | 0.75 | 0.8 |
| Example 34 | 0.4 | 2.1 | 60 | 25 | 0.73 | 0.8 |
| Example 35 | 0.4 | 0.3 | 60 | 9 | 0.03 | 0.05 |
| Comparative Example 1 | — | — | 0 | 11 | — | 2.3 |
| Comparative Example 2 | — | — | 0 | 15 | — | 0.05 |

TABLE 4

| | Micro hardness of surface (°) | Surface roughness Rz (μm) | Surface roughness Sm (μm) | Thickness of surface layer (μm) | Electric resistance value (Ω) |
|---|---|---|---|---|---|
| Example 1 | 55 | 8.1 | 50 | 14 | $8.2 \times 10^4$ |
| Example 2 | 58 | 13 | 65 | 16 | $8.5 \times 10^4$ |
| Example 3 | 60 | 17 | 85 | 21 | $4.5 \times 10^4$ |
| Example 4 | 58 | 18 | 75 | 20 | $5.5 \times 10^4$ |
| Example 5 | 51 | 3.5 | 35 | 11 | $3.2 \times 10^5$ |
| Example 6 | 60 | 8.0 | 34 | 24 | $4.2 \times 10^5$ |
| Example 7 | 56 | 28 | 80 | 21 | $3.2 \times 10^5$ |
| Example 8 | 53 | 16 | 50 | 13 | $9.2 \times 10^5$ |
| Example 9 | 56 | 14 | 55 | 19 | $9.5 \times 10^5$ |
| Example 10 | 56 | 13 | 75 | 18 | $4.4 \times 10^5$ |
| Example 11 | 50 | 16 | 66 | 10 | $8.1 \times 10^5$ |
| Example 12 | 40 | 18 | 60 | 5.2 | $8.3 \times 10^5$ |
| Example 13 | 65 | 10 | 45 | 25 | $6.3 \times 10^5$ |
| Example 14 | 48 | 27 | 80 | 5.1 | $7.1 \times 10^5$ |
| Example 15 | 65 | 18 | 65 | 24 | $7.5 \times 10^5$ |
| Example 16 | 43 | 16 | 55 | 6.5 | $8.1 \times 10^5$ |

TABLE 4-continued

| | Micro hardness of surface (°) | Surface roughness Rz (μm) | Surface roughness Sm (μm) | Thickness of surface layer (μm) | Electric resistance value (Ω) |
|---|---|---|---|---|---|
| Example 17 | 70 | 12 | 53 | 25 | $8.8 \times 10^5$ |
| Example 18 | 69 | 8.1 | 33 | 25 | $1.1 \times 10^6$ |
| Example 19 | 70 | 22 | 95 | 24 | $7.8 \times 10^5$ |
| Example 20 | 47 | 17 | 65 | 6.3 | $6.8 \times 10^5$ |
| Example 21 | 68 | 17 | 70 | 24 | $8.8 \times 10^6$ |
| Example 22 | 68 | 7.3 | 45 | 24 | $1.1 \times 10^7$ |
| Example 23 | 65 | 22 | 90 | 23 | $3.5 \times 10^6$ |
| Example 24 | 47 | 18 | 88 | 5.5 | $1.5 \times 10^6$ |
| Example 25 | 72 | 3.2 | 21 | 28 | $8.5 \times 10^6$ |
| Example 26 | 72 | 24 | 60 | 29 | $1.8 \times 10^7$ |
| Example 27 | 73 | 9.5 | 45 | 29 | $9.8 \times 10^6$ |
| Example 28 | 44 | 5.2 | 80 | 5.5 | $5.8 \times 10^6$ |
| Example 29 | 44 | 28 | 40 | 5.8 | $4.5 \times 10^7$ |
| Example 30 | 73 | 16 | 115 | 28 | $8.8 \times 10^6$ |
| Example 31 | 46 | 12 | 37 | 5.9 | $5.2 \times 10^6$ |
| Example 32 | 70 | 17 | 67 | 27 | $3.2 \times 10^6$ |

TABLE 4-continued

| | Micro hardness of surface (°) | Surface roughness Rz (μm) | Surface roughness Sm (μm) | Thickness of surface layer (μm) | Electric resistance value (Ω) |
|---|---|---|---|---|---|
| Example 33 | 45 | 9.1 | 45 | 7.1 | $6.6 \times 10^6$ |
| Example 34 | 45 | 24 | 65 | 6.8 | $3.1 \times 10^6$ |
| Example 35 | 70 | 8.8 | 50 | 28 | $6.0 \times 10^6$ |
| Comparative Example 1 | 71 | 10 | 44 | 28 | $5.5 \times 10^5$ |
| Comparative Example 2 | 65 | 8 | 35 | 14 | $5.3 \times 10^5$ |

TABLE 5

| | Image Evaluation Test 1 | | | |
|---|---|---|---|---|
| | Temperature 23° C. Humidity 50% | | Temperature 15° C. Humidity 10% | |
| | Initial stage | After 3000 sheets printing | Initial stage | After 6000 sheets printing |
| Example 1 | A | A | A | A |
| Example 2 | A | A | A | A |
| Example 3 | A | A | A | A |
| Example 4 | A | A | A | A |
| Example 5 | A | A | A | A |
| Example 6 | A | A | A | A |
| Example 7 | A | A | A | A |
| Example 8 | A | A | A | B |
| Example 9 | A | A | A | B |
| Example 10 | A | A | A | B |
| Example 11 | A | A | A | A |
| Example 12 | A | A | A | A |

TABLE 5-continued

| | Image Evaluation Test 1 | | | |
|---|---|---|---|---|
| | Temperature 23° C. Humidity 50% | | Temperature 15° C. Humidity 10% | |
| | Initial stage | After 3000 sheets printing | Initial stage | After 6000 sheets printing |
| Example 13 | A | A | B | C |
| Example 14 | A | A | A | B |
| Example 15 | A | A | B | C |
| Example 16 | A | A | A | B |
| Example 17 | A | A | C | C |
| Example 18 | A | A | B | C |
| Example 19 | A | A | C | C |
| Example 20 | A | A | B | C |
| Example 21 | A | B | C | C |
| Example 22 | A | C | C | C |
| Example 23 | A | B | C | C |
| Example 24 | A | B | B | C |
| Example 25 | A | B | C | C |
| Example 26 | A | C | C | C |
| Example 27 | A | B | C | C |
| Example 28 | A | B | B | C |
| Example 29 | A | B | C | C |
| Example 30 | A | C | C | C |
| Example 31 | A | B | C | C |
| Example 32 | A | C | C | C |
| Example 33 | B | C | C | C |
| Example 34 | B | C | C | C |
| Example 35 | C | C | C | C |
| Comparative Example 1 | B | D | C | D |
| Comparative Example 2 | C | D | C | D |

TABLE 6

| | Image Evaluation Test 2 | | | | |
|---|---|---|---|---|---|
| | Environment in which sample was left | | | | |
| | For one month in an environment of temperature of 30° C. and humidity of 80% | | | For one month in an environment of temperature of 40° c. and humidity of 95% | |
| | Test environment | | | | |
| | Temperature 23° C. Humidity 50% | | Temperature 15° C. Humidity 10% | Temperature 23° C. Humidity 50% | Temperature 15° C. Humidity 10% |
| | Initial stage | After 3000 sheets printing | After 3000 sheets printing | After 3000 sheets printing | After 3000 sheets printing |
| Example 1 | A | A | A | A | A |
| Example 2 | A | A | A | A | A |
| Example 3 | A | A | A | A | A |
| Example 4 | A | A | A | A | A |
| Example 5 | A | A | A | A | A |
| Example 6 | A | A | A | B | B |
| Example 7 | A | A | A | A | C |
| Example 8 | A | A | A | B | B |
| Example 9 | A | A | A | A | C |
| Example 10 | A | A | A | A | C |
| Example 11 | A | A | A | B | C |
| Example 12 | A | A | B | B | C |
| Example 13 | A | A | A | B | C |
| Example 14 | A | A | A | B | C |
| Example 15 | A | A | B | B | C |
| Example 16 | A | A | A | C | C |
| Example 17 | A | A | A | C | C |
| Example 18 | A | A | A | C | C |
| Example 19 | A | A | A | C | C |
| Example 20 | A | B | C | C | C |
| Example 21 | A | A | B | C | C |

TABLE 6-continued

| Image Evaluation Test 2 | | | | | |
|---|---|---|---|---|---|
| | Environment in which sample was left | | | | |
| | For one month in an environment of temperature of 30° C. and humidity of 80% | | | For one month in an environment of temperature of 40° c. and humidity of 95% | |
| | Test environment | | | | |
| | Temperature 23° C. Humidity 50% | | Temperature 15° C. Humidity 10% | Temperature 23° C. Humidity 50% | Temperature 15° C. Humidity 10% |
| | Initial stage | After 3000 sheets printing | After 3000 sheets printing | After 3000 sheets printing | After 3000 sheets printing |
| Example 22 | A | B | B | C | C |
| Example 23 | A | B | C | C | C |
| Example 24 | A | A | B | C | C |
| Example 25 | A | B | B | C | C |
| Example 26 | A | B | C | C | C |
| Example 27 | A | B | B | C | C |
| Example 28 | B | B | C | C | C |
| Example 29 | A | B | B | C | C |
| Example 30 | A | B | C | C | C |
| Example 31 | A | B | C | C | C |
| Example 32 | B | C | C | C | C |
| Example 33 | B | C | C | C | C |
| Example 34 | B | C | C | C | C |
| Example 35 | B | C | C | C | C |
| Comparative Example 1 | C | C | D | D | D |
| Comparative Example 2 | C | D | D | D | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-281601, filed Oct. 31, 2008, which is hereby incorporated by reference herein in its entirety.

What is claimed is:

1. A charging member comprising:

a conductive support; and a surface layer, wherein said surface layer comprises resin particles, each resin particle having a depressed portion on a surface thereof, and a binder in which said resin particles are dispersed, wherein protrusions resulting from said resin particles are formed on the surface of said surface layer, and each of said protrusions has a depressed portion resulting from said depressed portion of each of said resin particles, wherein said resin particles are covered with said binder, and wherein an opening diameter of each of said depressed portions is not less than 0.5 μm, and not more than 5 μm, and a maximum depth of each of said depressed portions is not less than 0.5 μm and not more than 2 μm.

2. A charging member comprising:

a conductive support; and a surface layer, wherein said surface layer comprises resin particles, each resin particle having a depressed portion on a surface thereof, and a binder in which said resin particles are dispersed, wherein protrusions resulting from said resin particles are formed on the surface of said surface layer, and each of said protrusions has a depressed portion resulting from said depressed portion of each of said resin particles, wherein said resin particles are covered with said binder, and wherein not less than 80% of the total number of protrusions that the surface of said surface layer has, are said protrusions resulting from said resin particles, and having said depressed portions, respectively.

3. A process cartridge comprising a charging member according to claim 1 and a photosensitive member disposed in contact with said charging member, and which is detachably mountable to a body of an electrophotographic apparatus.

4. An electrophotographic apparatus comprising a charging member according to claim 1, and a photosensitive member disposed in contact with said charging member.

5. A process cartridge comprising a charging member according to claim 2, and a photosensitive member disposed in contact with said charging member, and which is detachably mountable to a body of an electrophotographic apparatus.

6. An electrophotographic apparatus comprising a charging member according to claim 2, and a photosensitive member disposed in contact with said charging member.

* * * * *